US008115344B2

(12) United States Patent
Feng et al.

(10) Patent No.: US 8,115,344 B2
(45) Date of Patent: Feb. 14, 2012

(54) VERY LOW VOLTAGE, ULTRAFAST NANOELECTROMECHANICAL SWITCHES AND RESONANT SWITCHES

(75) Inventors: Philip Xiaoli Feng, Pasadena, CA (US); Matthew Matheny, Pasadena, CA (US); Rassul Karbalin, Pomona, CA (US); Michael L. Roukes, Pasadena, CA (US)

(73) Assignee: California Institute of Technology, Pasadena, CA (US)

( * ) Notice: Subject to any disclaimer, the term of this patent is extended or adjusted under 35 U.S.C. 154(b) by 348 days.

(21) Appl. No.: 12/546,485

(22) Filed: Aug. 24, 2009

(65) Prior Publication Data

US 2010/0140066 A1 Jun. 10, 2010

Related U.S. Application Data

(60) Provisional application No. 61/189,791, filed on Aug. 22, 2008.

(51) Int. Cl.
*H01H 59/00* (2006.01)

(52) U.S. Cl. ..... 307/112; 307/147; 307/149

(58) Field of Classification Search ..... 307/112, 307/147, 149
See application file for complete search history.

(56) References Cited

U.S. PATENT DOCUMENTS

| | | | | |
|---|---|---|---|---|
| 7,115,960 | B2 * | 10/2006 | Bertin et al. | 257/420 |
| 7,245,520 | B2 * | 7/2007 | Bertin et al. | 365/151 |
| 7,719,318 | B1 * | 5/2010 | Nordquist et al. | 326/104 |
| 2005/0093025 | A1 * | 5/2005 | Chen et al. | 257/211 |
| 2005/0245970 | A1 * | 11/2005 | Erickson et al. | 607/2 |

* cited by examiner

*Primary Examiner* — Fritz M Fleming
(74) *Attorney, Agent, or Firm* — Milstein Zhang & Wu LLC; Joseph B. Milstein

(57) ABSTRACT

The invention provides lateral nanoelectromechanical switches useful for integration into circuitry fabricated using standard semiconductor processing methods, or using techniques compatible with the mainstream semiconductor processing technologies. Methods of fabricating the switches are described. Some exemplary designs for two and three terminal switches are provided. Descriptions of structural features and the operating parameters for some exemplary switches are given. The switches are expected to be compatible with circuitry that is operable in computer-based systems.

17 Claims, 23 Drawing Sheets

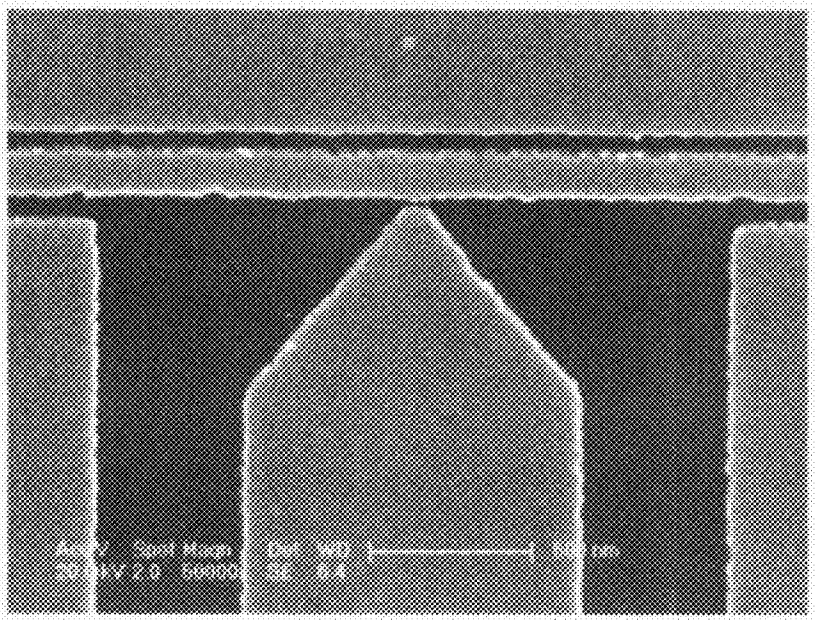
FIG. 10B
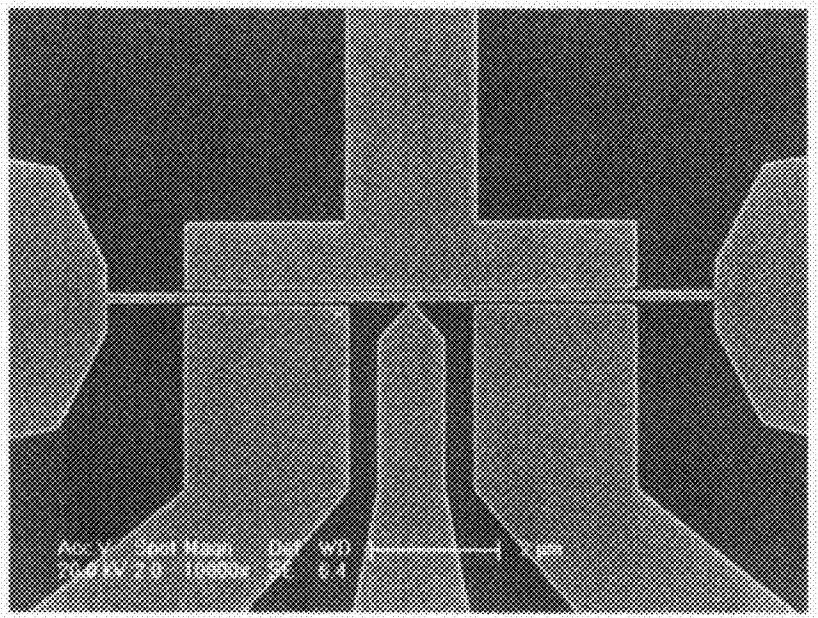
FIG. 10A
Fig. 10

FIG. 19A
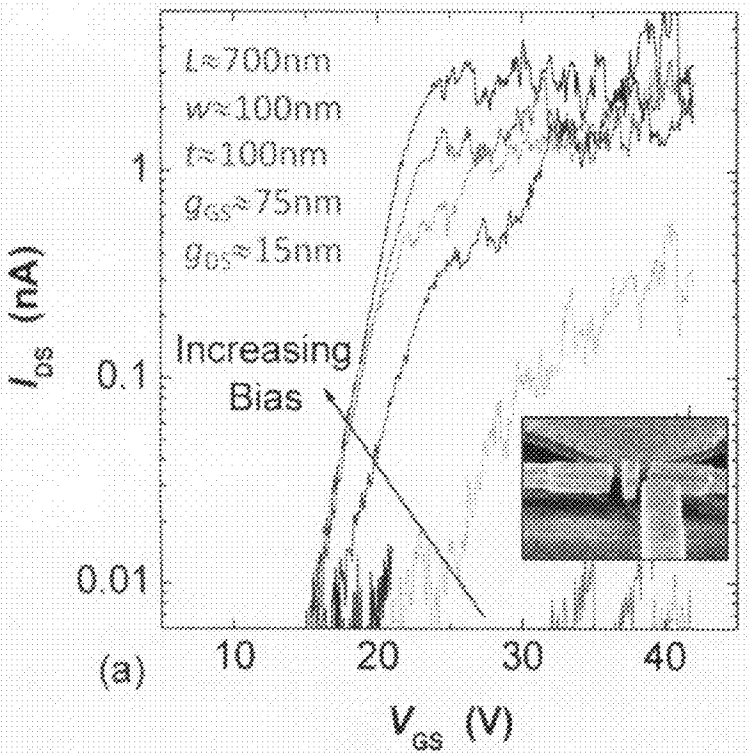
FIG. 19B
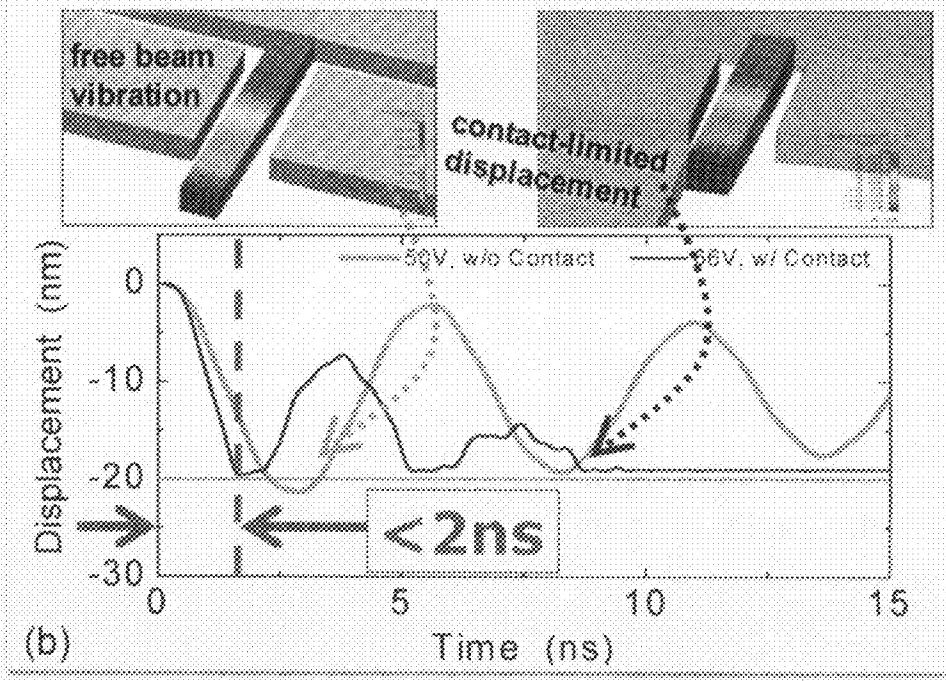
FIG. 19

FIG. 21A
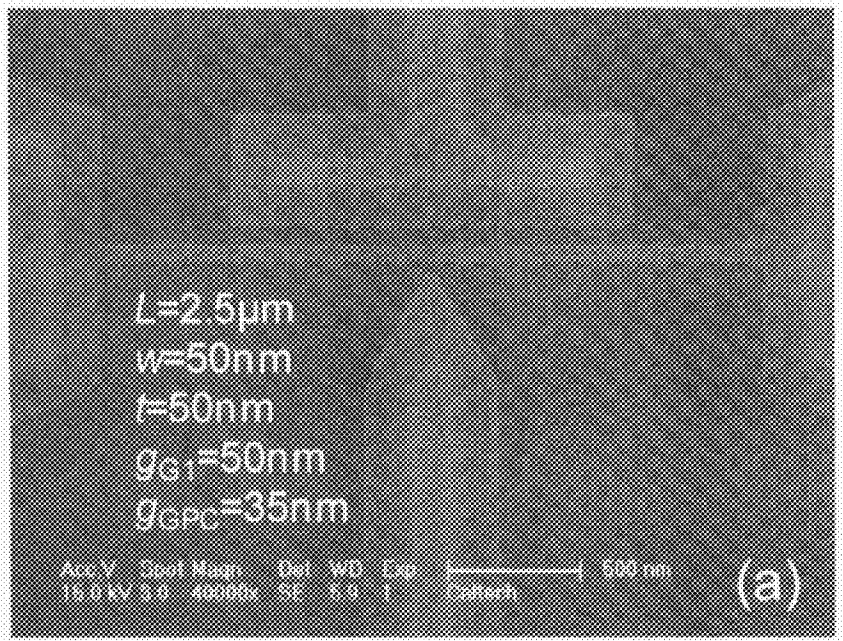
FIG. 21B
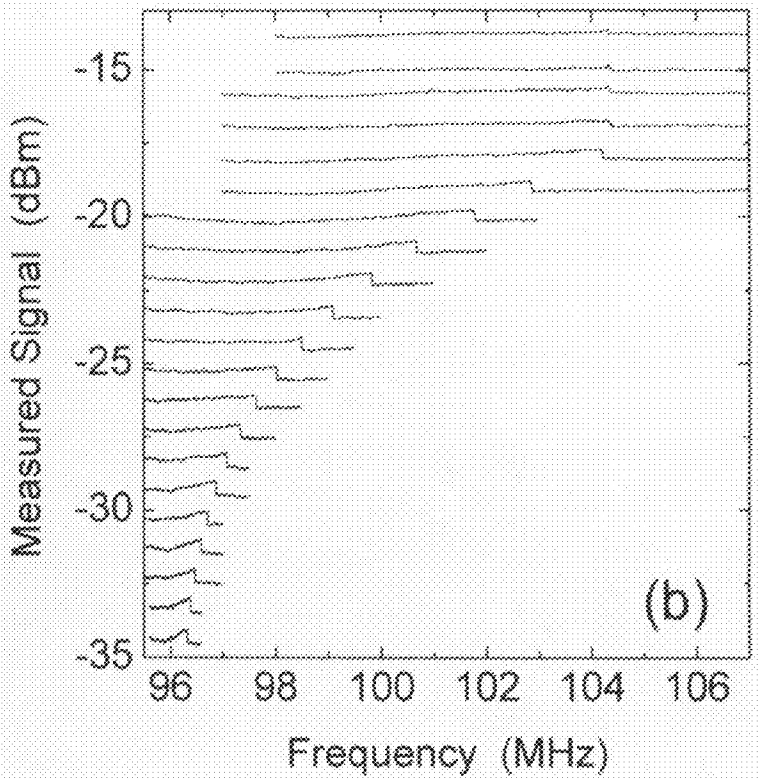
FIG. 21

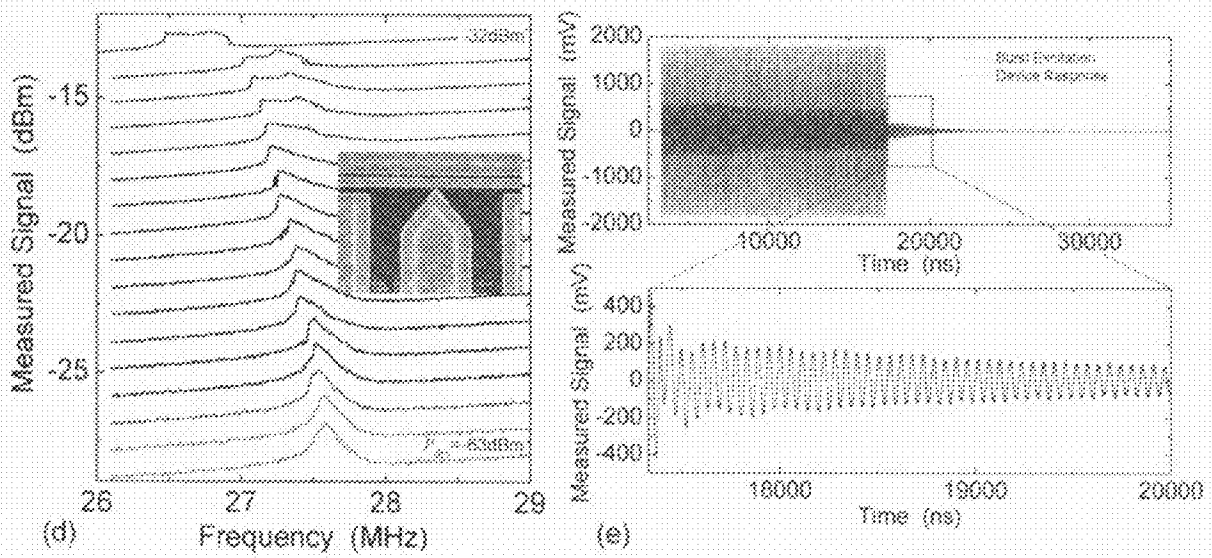
FIG. 22D
FIG. 22E
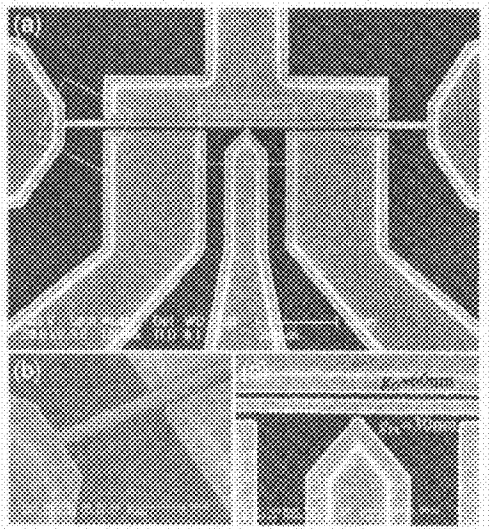
FIG.22A
FIG. 22B FIG.22C
FIG. 22

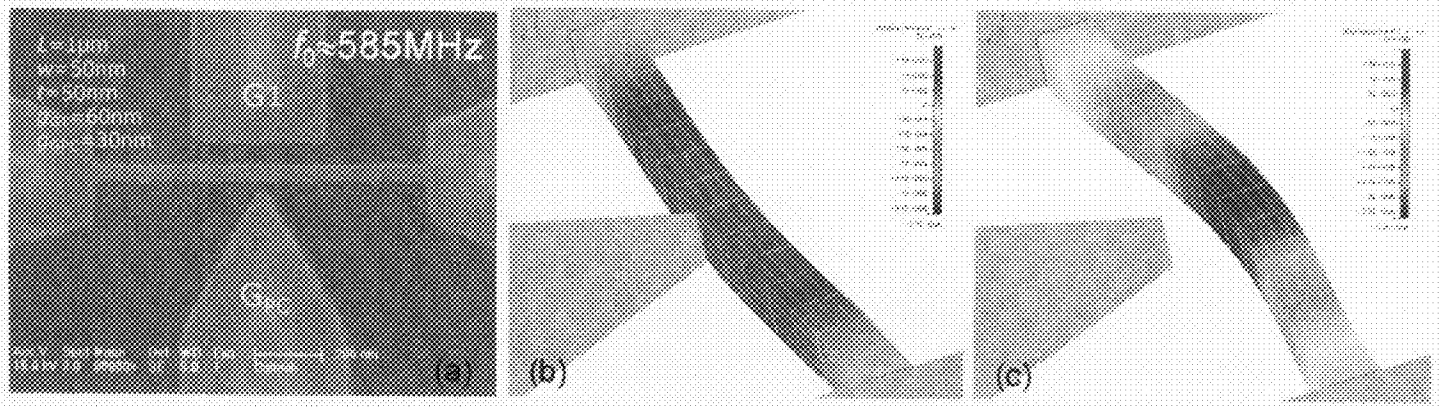
FIG. 23A
FIG. 23B
FIG.23C
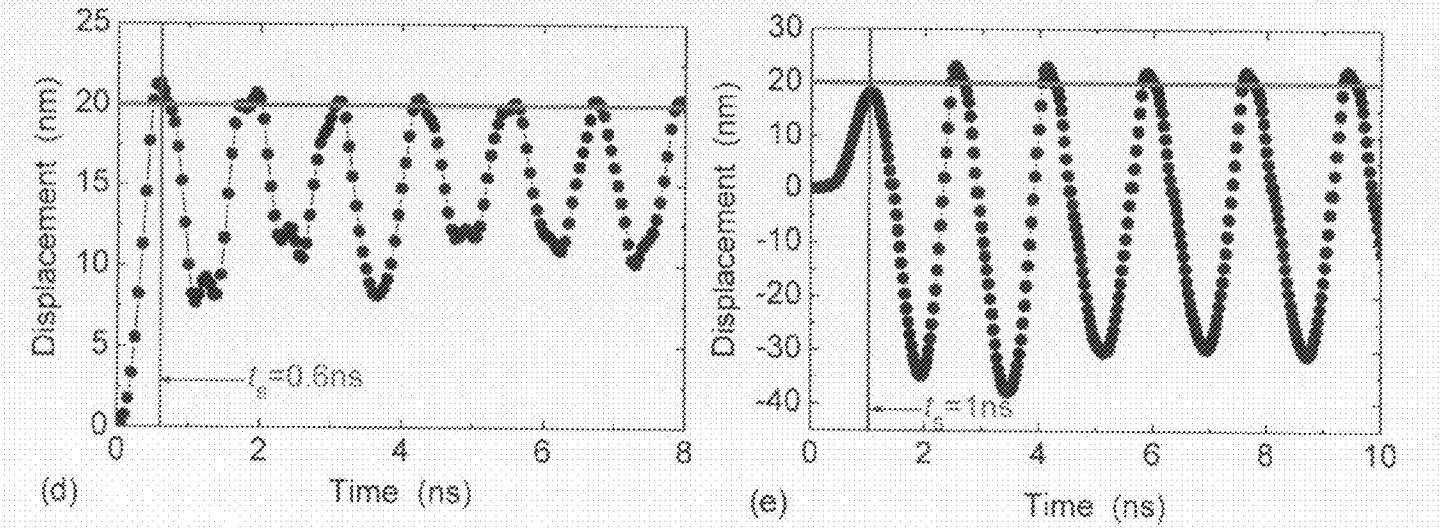
FIG. 23D
FIG. 23E

VERY LOW VOLTAGE, ULTRAFAST NANOELECTROMECHANICAL SWITCHES AND RESONANT SWITCHES

CROSS-REFERENCE TO RELATED APPLICATIONS

This application claims priority to and the benefit of co-pending U.S. provisional patent application Ser. No. 61/189,791, which application is incorporated herein by reference in its entirety.

STATEMENT REGARDING FEDERALLY FUNDED RESEARCH OR DEVELOPMENT

The U.S. Government has certain rights in this invention pursuant to Grant No. N66001-07-1-2039 awarded by ONR—Space and Naval Warfare Systems Center (SSC).

THE NAMES OF THE PARTIES TO A JOINT RESEARCH AGREEMENT

NOT APPLICABLE

INCORPORATION-BY-REFERENCE OF MATERIAL SUBMITTED ON A COMPACT DISC

NOT APPLICABLE

FIELD OF THE INVENTION

The invention relates to switches in general and particularly to switches that are constructed using nanoelectromechanical systems (NEMS) and methods.

BACKGROUND OF THE INVENTION

U.S. Pat. No. 7,446,044, titled "Carbon nanotube switches for memory, RF communications and sensing applications, and methods of making the same," issued to Kaul et al. on Nov. 4, 2008, and assigned to the assignee of the present application, describes switches constructed using carbon nanotubes. The switches described therein are claimed to provide switching times of the order of nanoseconds. However, such switches are not conveniently constructed using systems and methods compatible with standard semiconductor processing technology.

A recent paper entitled "Design Optimization of NEMS Switches for Single-Electron Logic Applications" by Benjamin Pruvost, Hiroshi Mizuta, and Shunri Oda describes designs and simulations of vertical NEMS switches used to control a variable capacitance in a single electron transistor that could operate in times of some tens of nanoseconds (e.g., 30 ns or more).

There is a need for mechanical switches that provide very high speed switching and that are compatible with conventional semiconductor processing technology.

SUMMARY OF THE INVENTION

According to one aspect, the invention relates to a nanoelectromechnical switch. The nanoelectromechnical switch comprises a substrate having a surface; a layer of conductive material in supported relation to the surface of the substrate, the layer of conductive material having defined therein a nanoelectromechanical switching structure, the nanoelectromechanical switching structure comprising at least one contact electrode having a contact region and having an electrical signal terminal; at least one nanowire having at least one point of support in the layer of conductive material and having an electrical signal terminal, the nanowire configured to move along a plane situated within the layer of conductive material and relative to the at least one electrical contact in response to an electrical signal applied to a gate electrode to control an electrical conduction state between the at least one contact electrode and the nanowire to be a selected one of conduction and lack of conduction, the gate electrode disposed in proximity to the nanowire; and at least one pair of electrical terminals configured to provide connection of the switching structure to an external circuit. The nanoelectromechanical switching structure is configured to respond to the signal applied to the gate electrode in a response time of less than 10 nanoseconds.

In one embodiment, the nanoelectromechnical switch further comprises an insulating layer between the substrate and the layer of conductive material.

In one embodiment, the response time is less than 1 nanosecond. In one embodiment, the signal applied to the gate electrode is a voltage signal of substantially one volt. In one embodiment, the signal applied to the gate electrode is a voltage signal of less than one volt. In one embodiment, the conductive material comprises a selected one of silicon, diamond, and silicon carbide. In one embodiment, at least one of the at least one contact and the nanowire is metallized with a metal selected from the group consisting of gold, platinum, silver, titanium, aluminum, and copper. In one embodiment, the nanowire is supported (and clamped) by the layer of conductive material at two points. In one embodiment, the switch is configured as a two terminal device. In one embodiment, the electrical signal applied to the gate electrode to control an electrical conduction state is a DC electrical signal. In one embodiment, the electrical signal applied to the gate electrode to control an electrical conduction state is an AC electrical signal.

In one embodiment, the nanoelectromechnical switch further comprises at least a second contact electrode, the second contact electrode having a contact region and having an electrical terminal configured to receive an electrical signal. In one embodiment, the nanowire and the contact electrodes are configured as a three terminal device. In one embodiment, the gate electrode has a pointed configuration. In one embodiment, the nanoelectromechnical switch further comprises a second gate electrode, the second gate electrode configured to pull the nanowire away from the contact region of the contact electrode. In one embodiment, the nanoelectromechanical switch comprises two doubly-clamped nanowires, each having a protruding region, the two protruding regions configured to provide contact with each other. In some embodiments, the nanoelectromechanical switch is configured to operate in a resonant mode in response to an applied control signal.

The foregoing and other objects, aspects, features, and advantages of the invention will become more apparent from the following description and from the claims.

BRIEF DESCRIPTION OF THE DRAWINGS

The objects and features of the invention can be better understood with reference to the drawings described below, and the claims. The drawings are not necessarily to scale, emphasis instead generally being placed upon illustrating the principles of the invention. In the drawings, like numerals are used to indicate like parts throughout the various views.

FIG. 10A is a diagram of a prototype NEMS beam lateral switch with point contact and complementary configuration of multiple gate electrodes. The right panel (FIG. 10B) shows an expanded view of the point contact region, illustrating a 20 nm switching gap.

FIG. 15 is a diagram showing NEMS switches with ultra-thin device widths and coupling gaps made by top-down nanofabrication in a negative mask process employing HSQ as the resist for pattern definition via electron-beam lithography.

FIG. 16 is a diagram showing low voltage 2-terminal NEMS DC switches based on metalized nanowires with metal-metal contacts.

FIG. 19A is a diagram showing a three-terminal NEMS switching events with many cycles at various bias conditions.

FIG. 19B is a diagram showing simulations based on finite element method (FEM) demonstrating the expected switching speed of this particular device should be <2 ns.

FIG. 21A is an SEM image of a ~100 MHz, ultrafast resonant-mode NEMS switch device.

FIG. 21B is a diagram showing the measured resonant responses showing nonlinear and impacting gate behaviors.

FIG. 22A is an image of a ~28 MHz resonant-mode NEMS switch device.

FIG. 22B is an expanded view of a portion of the device shown in FIG. 22A.

FIG. 22C is another expanded view of a portion of the device shown in FIG. 22A.

FIG. 22D is a diagram showing the measured frequency-domain responses showing linear, nonlinear and impacting gate behaviors. The inset is similar to FIG. 22C, showing the point contact area of the particular device.

FIG. 22E is a diagram showing the measured time-domain ringing behavior showing the speed of the device of FIG. 22A.

FIG. 23A is an SEM image of a NEMS resonant switch device that offers ultra-high frequency (UHF) operation at above 500 MHz.

FIG. 23B is a diagram illustrating a snapshot of a finite element model analysis simulation of the device responses upon step excitation. The snapshot demonstrates the device is at contact with the point contact electrode.

FIG. 23C is a diagram illustrating a snapshot of a finite element model analysis simulation of the device responses upon resonant excitation. The snapshot shows that the device is away from the contact electrode.

FIG. 23D is a graph showing the simulated response upon a step excitation.

FIG. 23E is a graph showing the simulated response upon a resonant excitation.

DETAILED DESCRIPTION

Overview

We present a number of novel designs and prototypes of nanoscale mechanical switches with lateral contacts employing nanoelectromechanical systems (NEMS) technologies. Such devices are expected to provide ultralow-power, ultra-high-speed NEMS switching technologies useful in such applications as nanomechanical logic and computation, and in hybrid integration of NEMS and nanoelectronics. Lateral (in-plane) contacts for NEMS switches, in contrast to vertical (out-of-plane) switches, have the significant advantage of ease in device patterning and nanofabrication. We describe prototype devices with various lateral contacts, including simple contacts, point contacts, and nanoscale regional protruding contacts. Each contact design has advantages for particular applications. We refer to the lateral displacement of the nanowire by describing the nanowire as being configured to move along a plane situated within the layer of conductive material.

We present initial demonstrations of very low actuation voltage (~1 Volt), ultrafast (~1 ns) nanoscale switches based on nanoelectromechanical systems (NEMS). It is believed that such low actuation voltages and switching speeds are unprecedented for switches based upon mechanical devices. These NEMS switches surpass their microscale counterparts in devices specifications and performance, by orders of magnitudes (e.g., ~$10^3$-$10^4$ fold improvement in switching speeds and ~10-$10^2$ reduction in actuation voltages, and ~$10^3$-$10^6$ or more reduction in device volumes).

Designs of the Lateral NEMS Switches

NEMS Switches with Simple Lateral Contacts

Figure 1:
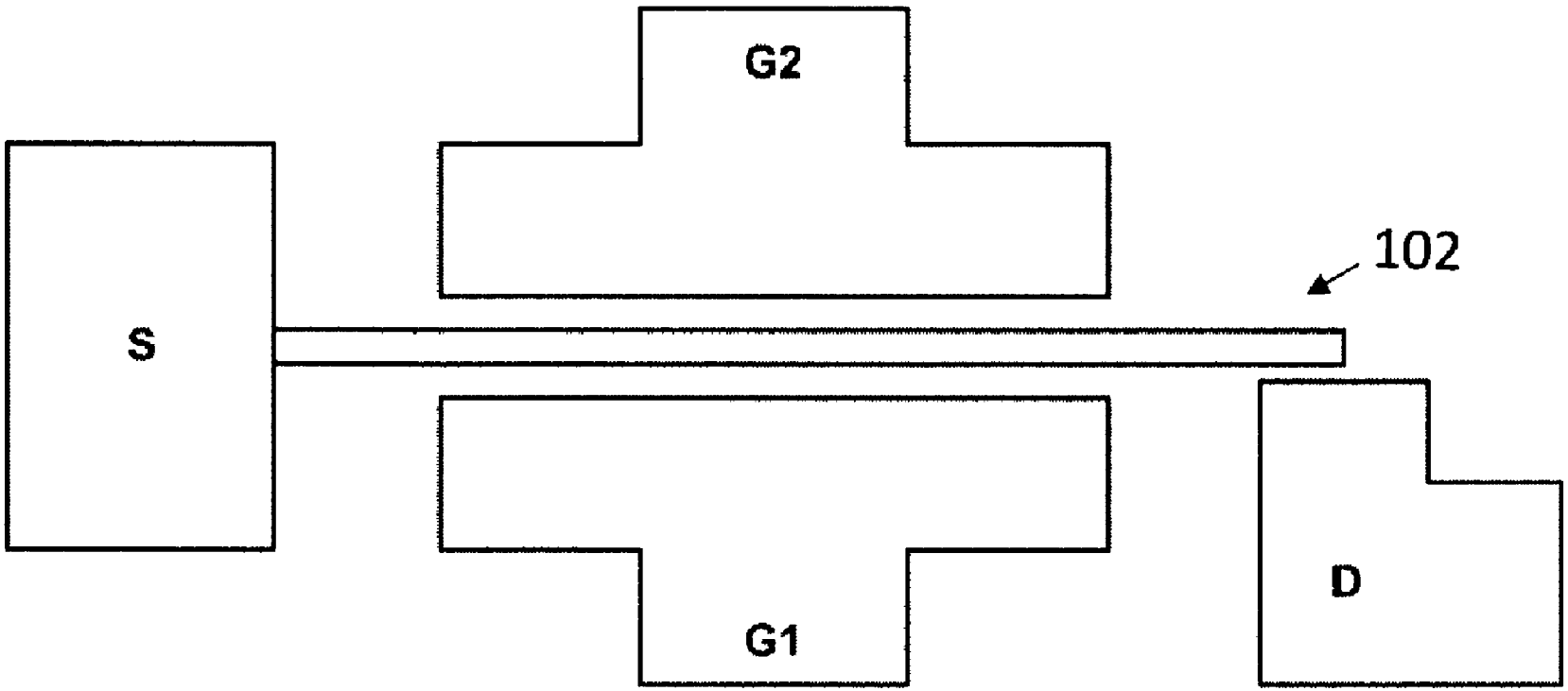
FIG. 1 is an illustrative diagram in plan view of a design of an electrostatic NEMS switch with a simple lateral contact, according to principles of the invention.

FIG. 1 illustrates the structure of a NEMS switch with a simple lateral contact. It is based on a NEMS cantilever device (e.g., a beam supported at one end or one point) with electrostatic actuation. When voltage is applied on the gate G1, the nanocantilever 102 is actuated to make a contact to the drain (D) electrode, thus switching on the path from the source (S) to the drain (D). Gate G2 is designed to enable active pull-off for the cantilever when the cantilever is still in contact with S after the actuation voltage is removed (i.e., when the stiction force is larger than the cantilever's restoring force). In this design, there is a nanoelectromechanical switching structure that comprises a contact electrode having a contact region and having an electrical signal terminal, a nanowire 102 having at least one point of support in the layer of conductive material in which the lateral switch is fabricated and having an electrical signal terminal. The nanowire is configured to move relative to the electrical contact in response to an electrical signal applied to a gate electrode to control an electrical conduction state between the contact electrode and the nanowire. The conduction state is a selected one of conduction and lack of conduction. The switching structure has at least one pair of electrical terminals configured to provide connection of the switching structure to an external circuit. In some embodiments, the nanoelectromechanical switching structure is configured to respond to the signal applied to the gate electrode in a response time of less than 10 nanoseconds.

We have fabricated prototypes include devices made from such substrates as polycrystalline silicon nitride ($SiN_x$) on silicon (Si), single-crystal silicon carbide (SiC) on silicon, polycrystalline SiC on Si, and silicon-on-insulator (SOI) structures, e.g., single-crystal silicon on silicon oxide ($SiO_2$). We have used a gold (Au) metallization layer on top. Au serves as an etch mask in NEMS device fabrication, and also as contact material. The design shown in FIG. 1 has the advantage that one can easily characterize parameters such as the DC switching behavior, switching voltage, contact resistance, and the stiction force, for example.

Lateral NEMS Switches with Point Contacts

Figure 2:
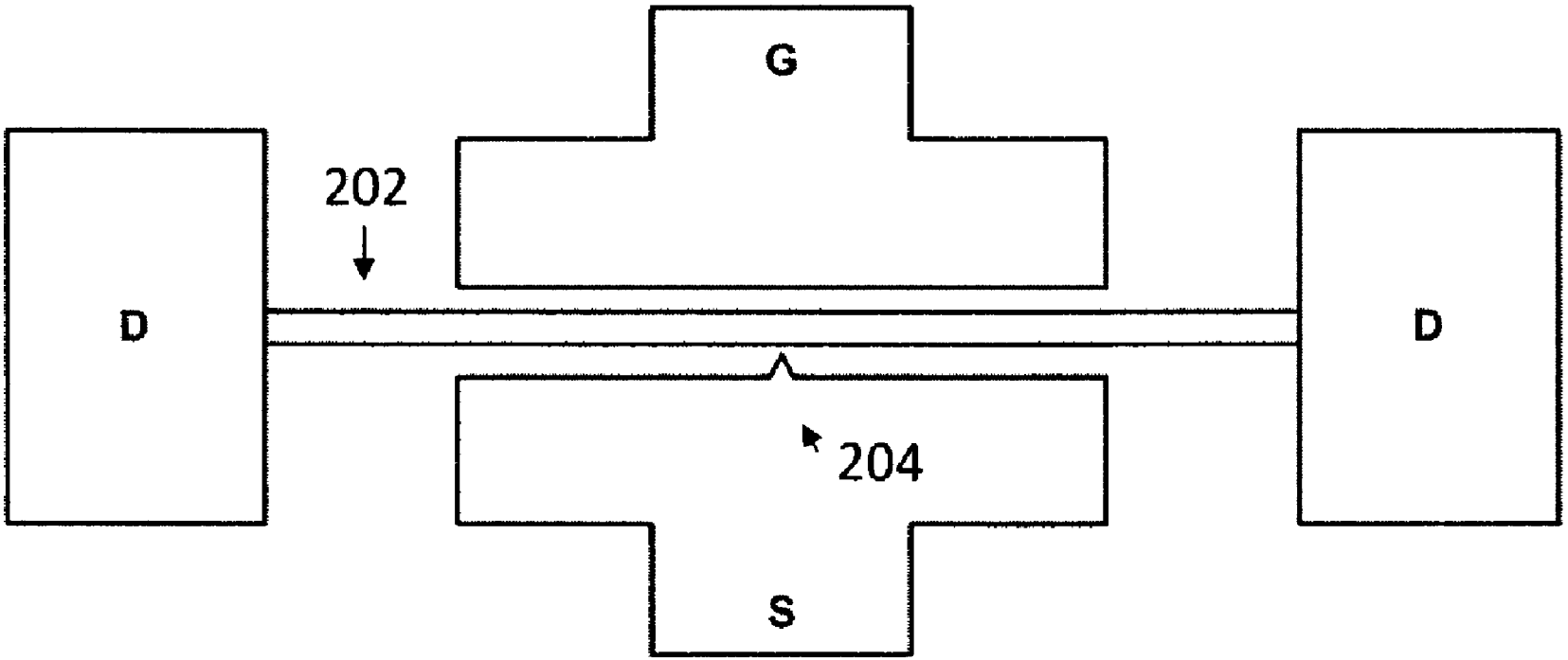
FIG. 2 is an illustrative diagram in plan view of a design of a lateral electrostatic NEMS switch and resonator with a lateral point contact, according to principles of the invention.

FIG. 2 shows a design of the lateral NEMS switch with a point contact. This design is based on a doubly-clamped (or doubly-supported) beam 202. This design is particularly interesting for AC switching at the beam's fundamental mode flexural resonance. When an AC signal is applied at gate G to excite the beam into resonant motion (with amplified displacement, by the device quality factor, Q, as compared to static deflection in the DC mode), the point contact 204 (for example, at the midpoint of the beam) between the source (S) and the drain (D) is modulated by the resonant motion and the irreversible and often destructive stiction behavior is effectively avoided by the use of the point contact. When the gap at the point contact is sufficiently small and the beam displacement amplitude is large, the point contact resistance changes will provide a switching behavior with very high switching on-to-off ratio. Among the advantages of such design and prototype are that it can be used as a NEMS resonator with integrated signal transduction. The design is also suitable for characterization of the switching speed, time-domain performance of the switching dynamics, and the physics of electrical contact resistance at the single point contact.

Figure 3:
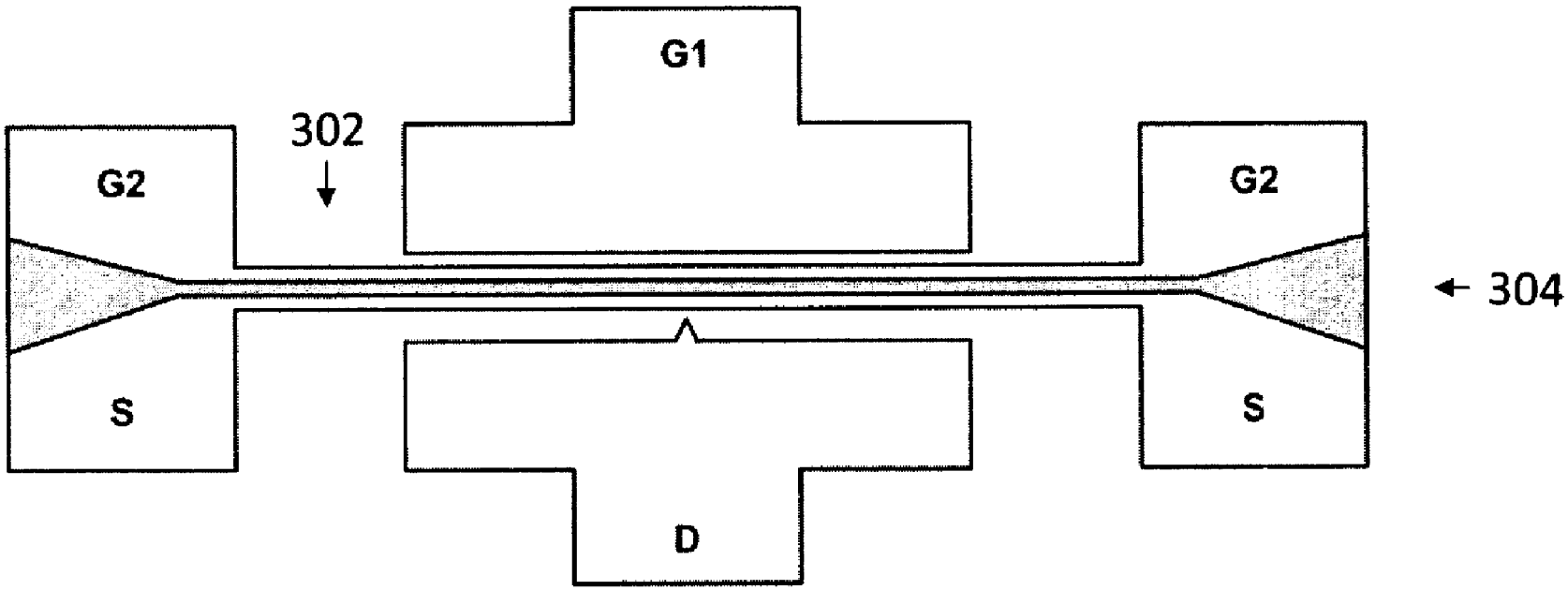
FIG. 3 is an illustrative diagram in plan view of a design of a lateral electrostatic NEMS switch with a lateral point contact, showing the conductive patterns and insulating pattern.

It is expected that lateral NEMS switches with point contact are versatile for both AC and DC switching. FIG. 3 shows another design that is a little more complex which provides functionality for both AC and DC switching. The doubly supported beam 302 includes an insulating region 304 that divides the beam 302 into two separate conductive regions. By creating two separate electrodes on the beam, it is much easier to bias the point contact resistance using either AC or DC control signals. For example, in the DC switching mode, when voltages of same polarization are applied to the gate electrodes (G1 and G2) and charge is built up to induce repulsion of the two gates (note that one gate is on the beam), the beam is deflected to the point contact, hence the device switches on by connecting drain (D) and source (S) via the point contact.

Figure 4:
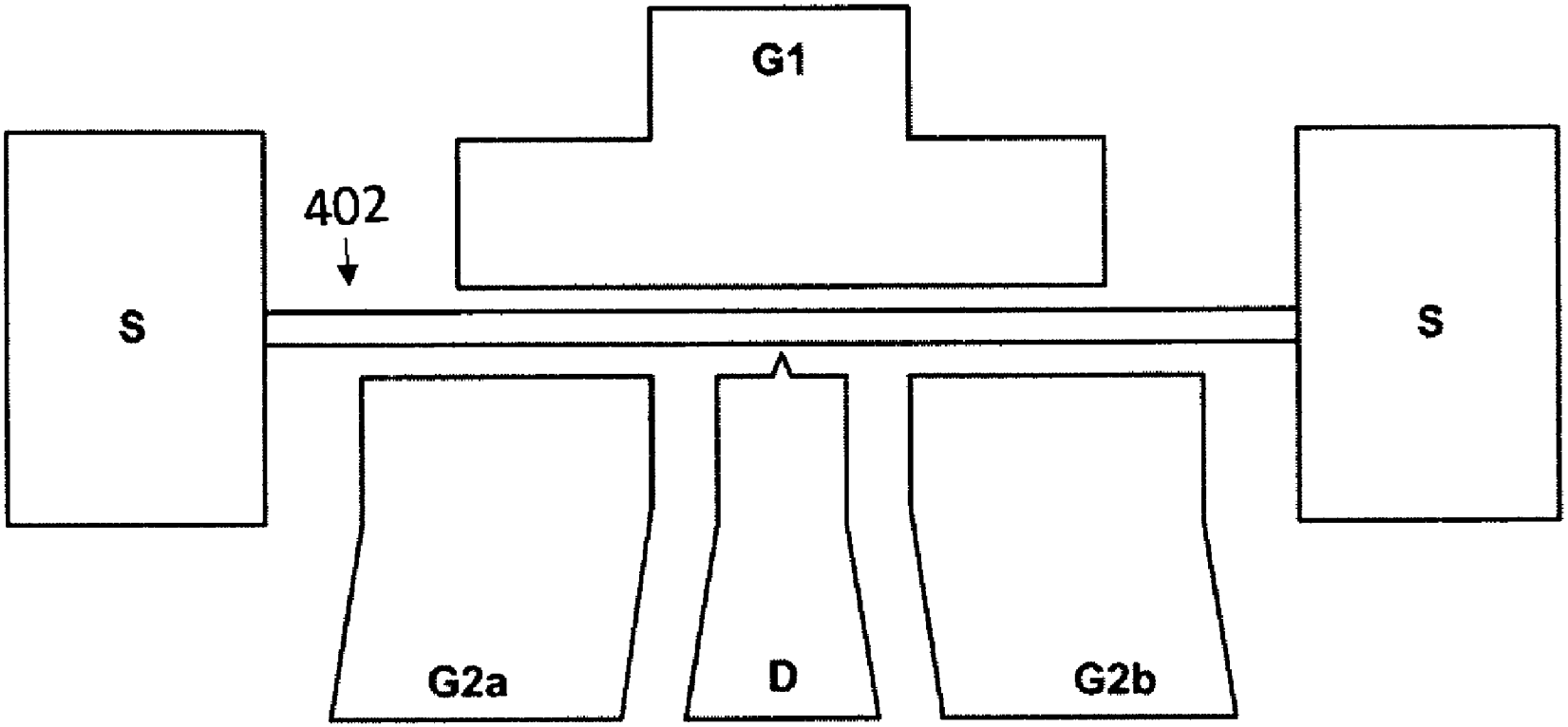
FIG. 4 is an illustrative diagram in plan view of a design of an electrostatic NEMS switch with a lateral point contact with complementary controls enabled by multiple gate electrodes.

FIG. 4 shows another more flexible design with a novel configuration of the gate electrodes. In the DC switching mode, gates G2*a* and G2*b* can be polarized at the same voltage, to pull down the beam 402 and make contact from source (S) to drain (D), thereby attaining a conductive state. Gate G1 can be used to actively pull the beam 402 away from the point contact. In the AC switching mode, either of gates G1 and G2 can be employed to excite the beam 402 into resonant motion. This can provide a periodic switch having a characteristic switching time. The NEMS resonance induced switching on/off behavior at the point contact can then be extracted via measurements using appropriate bias through the drain (D) to source (S).

Lateral NEMS Switches with Nanoscale Protrusion Contacts

Figure 5:
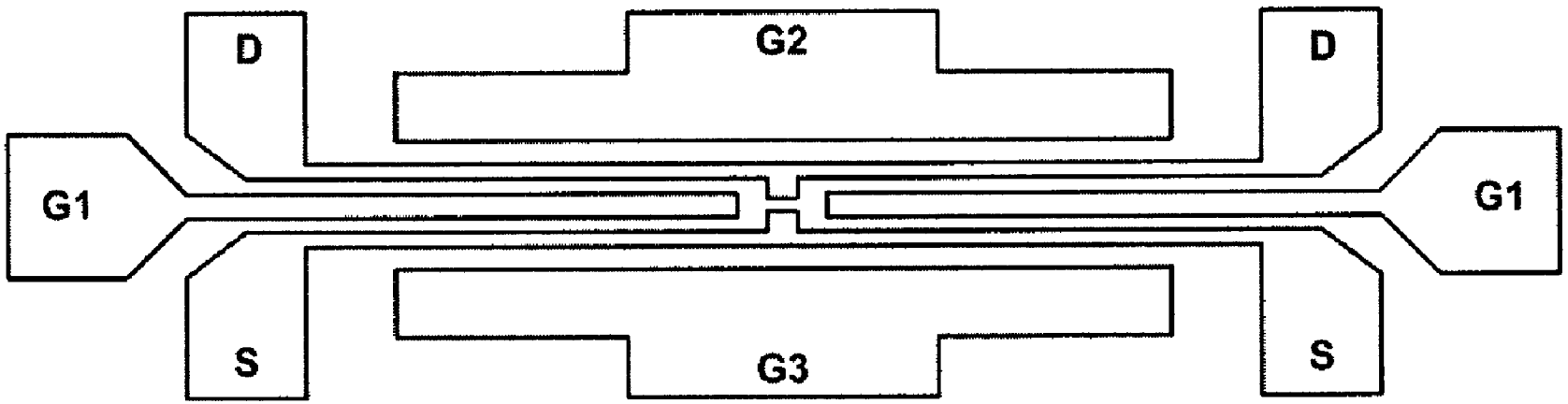
FIG. 5 is an illustrative diagram in plan view of a design of an electrostatic NEMS switch formed by two beams with lateral protrusion contacts.

FIG. 5 shows another novel design of a lateral electrostatic NEMS switch. The device comprises two doubly-clamped beams, each having a protruding region (wider than the point contact) in the middle, such that the protrusions are facing each other. While the two protrusions provide an electrical connection when the beams are pulled to make contact, they also avoid the pull-in and stiction of the whole beams. In DC switching mode, DC voltage can be applied to the gate G1 to pull the beams into contact at the protruding region. If needed, gates G2 and G3 can be used to actively pull off the beams from contact. In the resonant operation mode, gate G1 can be used to excite both beams into out-of-phase resonant motions. Alternatively, gates G2 and G3 can be used to excite one of the beams, respectively.

One can expect that in the design shown in FIG. 5, the contact resistance from the protrusion contact should be smaller than that in a point contact, while both allow for very narrow local gaps at the contacts and also effectively avoid pull-in and stiction of the whole beam structures.

The design shown in FIG. 5 is attractive for logic switching (i.e., switching DC signals through drain D to source S when the DC contact is made). It also is expected to be interesting for switching RF signals through D to S when the small gap is utilized as a coupling capacitor. For the latter purpose, specific designs need to take into consideration the details of the structural dimensions and the frequency response characteristics of the capacitive coupling. It is expected that this design can also be used for NEMS resonator and oscillator applications with various transduction and coupling options available based on the configuration of the gate electrodes.

Figure 6:
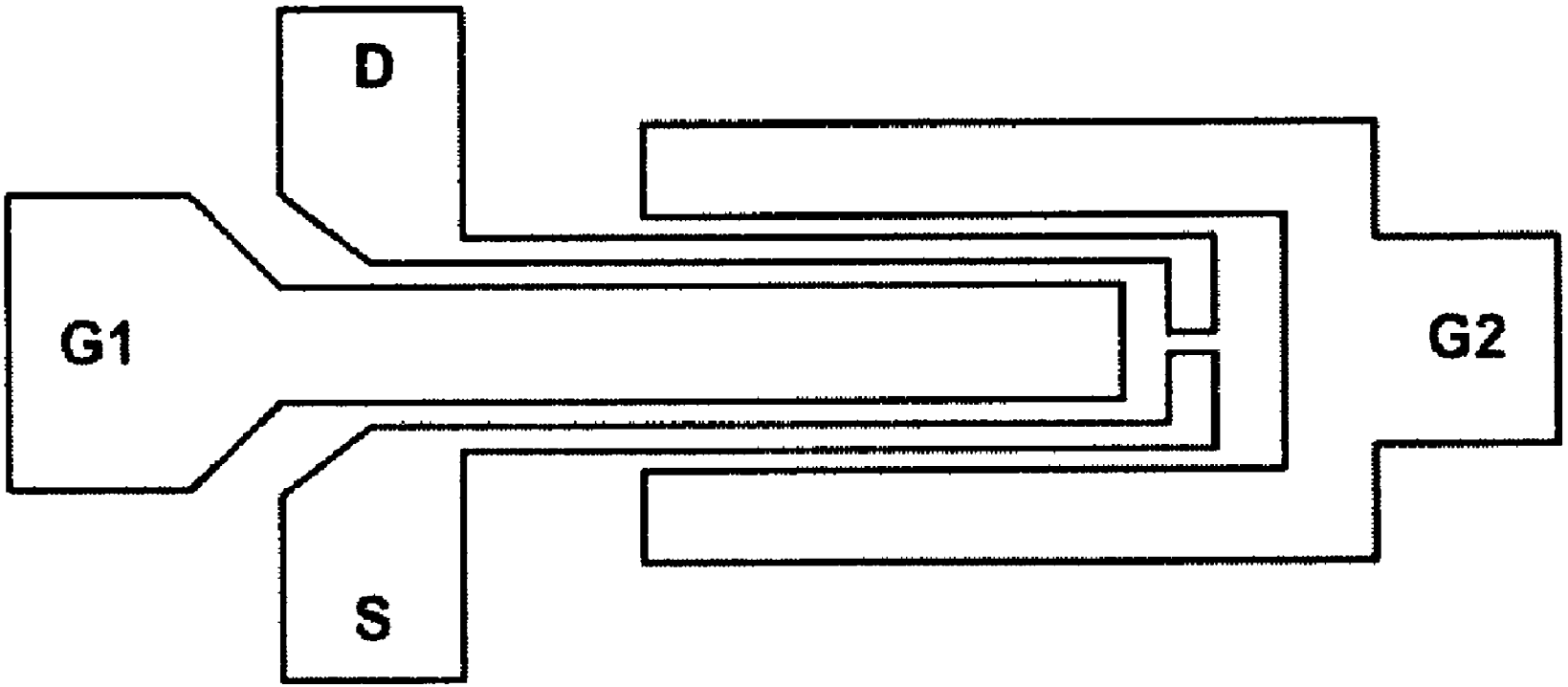
FIG. 6 is an illustrative diagram in plan view of a design of an electrostatic NEMS switch formed by two cantilevers with lateral protrusion contacts.

FIG. 6 illustrates a similar design, based on two cantilevers with lateral protrusion contacts, also configured with complementary gate electrodes.

Fabrication Processes

Figure 7:
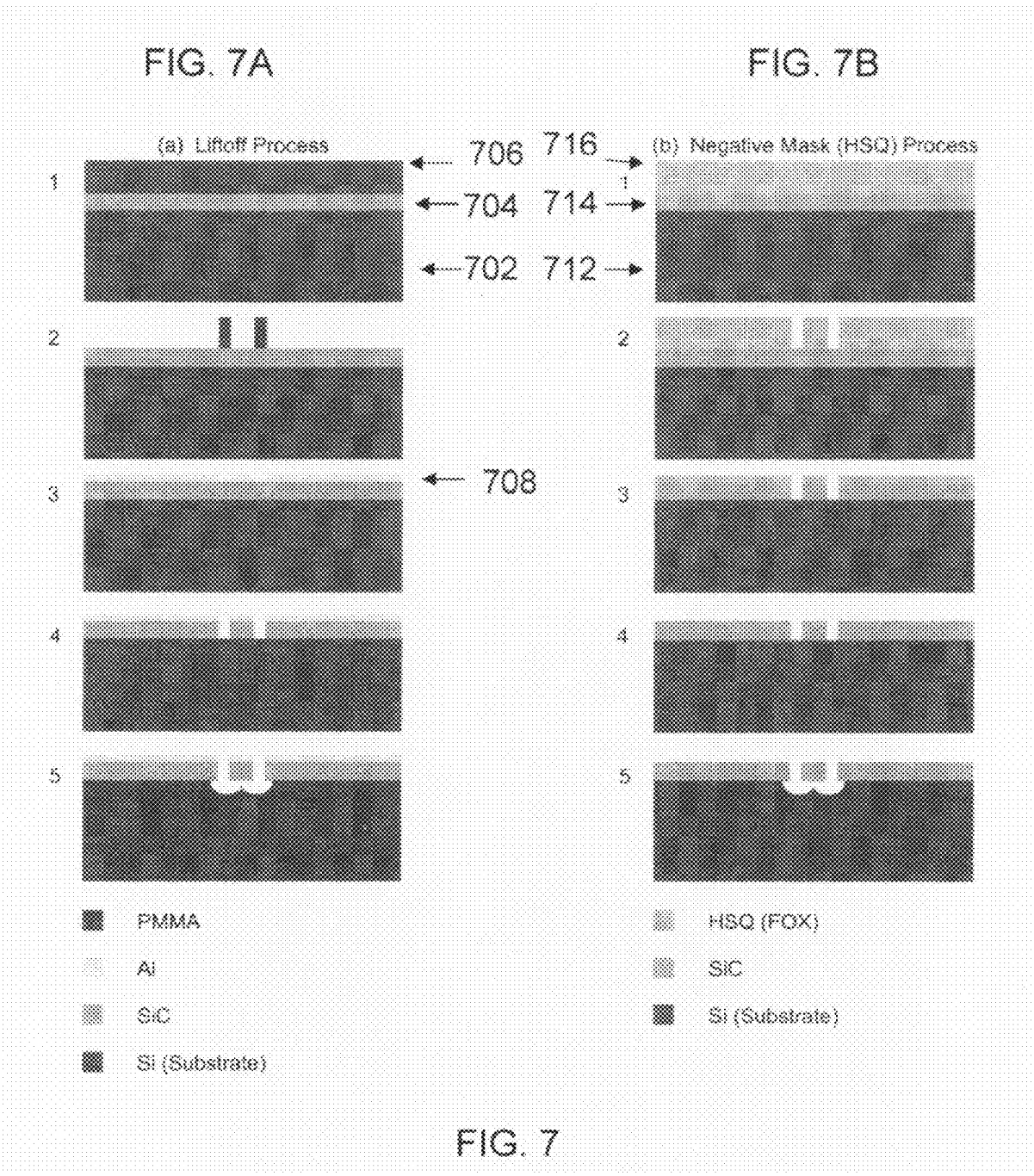
FIG. 7A is a diagram illustrating in elevation view a nanofabrication process using a liftoff process.
FIG. 7B is a diagram illustrating in elevation view a nanofabrication process using a negative mask process.

We have fabricated devices by top-down nanofabrication processes involving both lithographical pattern transfer and surface nanomachining using plasma dry etch. We have developed two distinct processes for realizing such devices with ultra-thin beams and gaps: (i) the liftoff process as shown in FIG. 7A and (ii) the negative mask process illustrated in FIG. 7B. High-resolution electron-beam lithography (EBL) has been employed in both processes for defining the small features such as the very thin beams and gaps.

In the liftoff process, the EBL resist is polymethyl-methacrylate (PMMA). FIG. 7A is an elevation view through a section of a device. As shown in FIG. 7A, step 1, there is provided a substrate 702 (for example Si) supporting a layer of material 704 from which the switching structure is made (for example, SiC), and the PMMA 706 resist is applied. As shown in FIG. 7A, step 2, the exposure and develop operations create a pattern in the PMMA. As shown in FIG. 7A, step 3, the pattern is transferred by metallization and liftoff of a thin metal layer 708 (e.g., a thin layer of Al deposited by thermal evaporation or electron-beam evaporation). As shown in FIG. 7A steps 4 and 5, the device is then suspended by a two-step dry etch (anisotropic and isotropic) with the metallization layer being the etch mask.

In the negative mask process, the EBL resist is hydrogen silsesquioxane (HSQ), specifically XR-1541 2%, which serves as the negative mask. As shown in FIG. 7B, step 1, there is provided a substrate 712 (for example Si) supporting a layer of material 714 from which the switching structure is made (for example, SiC), and a layer of HSQ resist 716 is applied. As shown in FIG. 7B, step 2, the resist 716 is exposed and developed. As shown in FIG. 7B, step 3, after exposure and develop, the HSQ works as the etch mask for the anisotropic etching of the structural layer. As shown in FIG. 7B, step 4, the resist layer is removed. As shown in FIG. 7B, step 5, after removing the residue HSQ in an oxide etch, the device is suspended by selectively etching the sacrificial layer.

NEMS switching events in devices produced by both these processes have been demonstrated. Given the similar dimensions, the devices have similar performance in switching voltages and speeds. Preliminary data show that devices from the HSQ process (no metallization) can switch more cycles than similar devices from the liftoff process (with metallization). This implies that for these devices with nanoscale contacts, switching with metal-metal contacts (e.g., Al—Al, Au—Au) seems to be more destructive and less robust than with contacts with semiconductor materials such as SiC—SiC or Si—Si.

Examples of Structures Fabricated

We have fabricated several kinds of lateral NEMS switches based on the designs shown in FIG. 1 through FIG. 6. The lateral NEMS switch designs make it easier for the patterns to be defined and transferred using very few lithography steps. All of the devices have been fabricated using high-resolution electron-beam lithography techniques (e.g., Leica EBPG 5000+) in Caltech research labs. High-yield wafer scale patterning of large numbers of devices has been demonstrated. It is expected that such resolution and yields can be achieved with present state-of-the-art advanced lithography techniques in industrial settings.

Figure 8A:
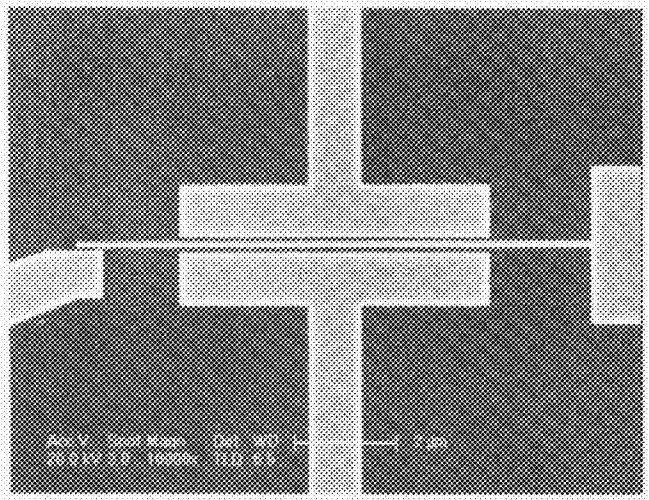
FIG. 8 is a diagram of a prototype NEMS cantilever lateral switch with a simple lateral contact. The panel on the right (FIG. 8A) shows an expanded view of the contacting area in the left panel (FIG. 8B), illustrating a very small switching gap of about 30 nm.
Figure 8B:
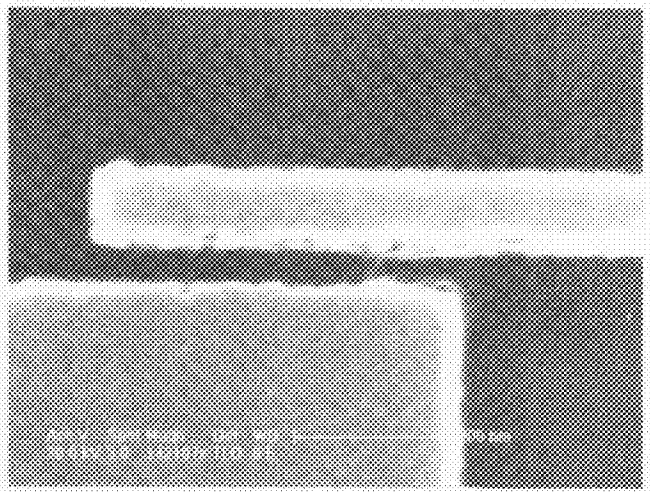

FIG. 8 displays one of the prototyped NEMS switches based on cantilevers with simple lateral contacts according to the schematic shown in FIG. 1. For very high speed operations, typical cantilever length is in the range of 1-10 μm, width and thickness are in the range of ~100-200 nm, the electrostatic coupling gap is in the range of ~50-100 nm, and the typical switching gap is in the range of ~20-30 nm wide.

Figure 9A:
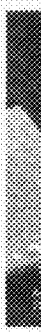
FIG. 9A is a diagram of a doubly-clamped beam lateral NEMS switch with a point contact. The center panel (FIG. 9B) and the right panel (FIG. 9C) show progressively expanded views of the point contact region, illustrating a 20 nm switching gap.
Figure 9B:
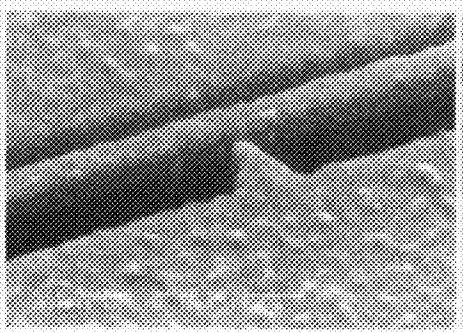
Figure 9C:
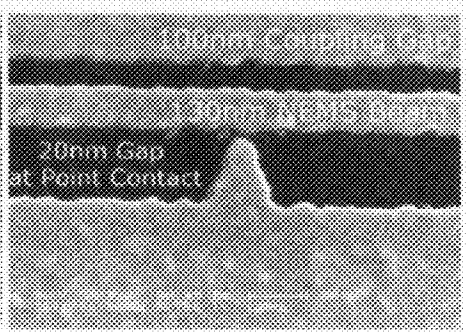

FIG. 9 shows one of the prototyped doubly-clamped beam NEMS switches with point contact (schematic shown in FIG. 2). Typical devices have electrostatic gate coupling gaps in the range of ~50-100 nm, and ~20 nm switching gaps at the point contact are achieved.

FIG. 10 displays one of the prototyped NEMS switch device as schematically illustrated in FIG. 4. Typical dimensions for such devices are similar for those achieved in the device shown in FIG. 9.

Figures 11A, 11B, 11C:
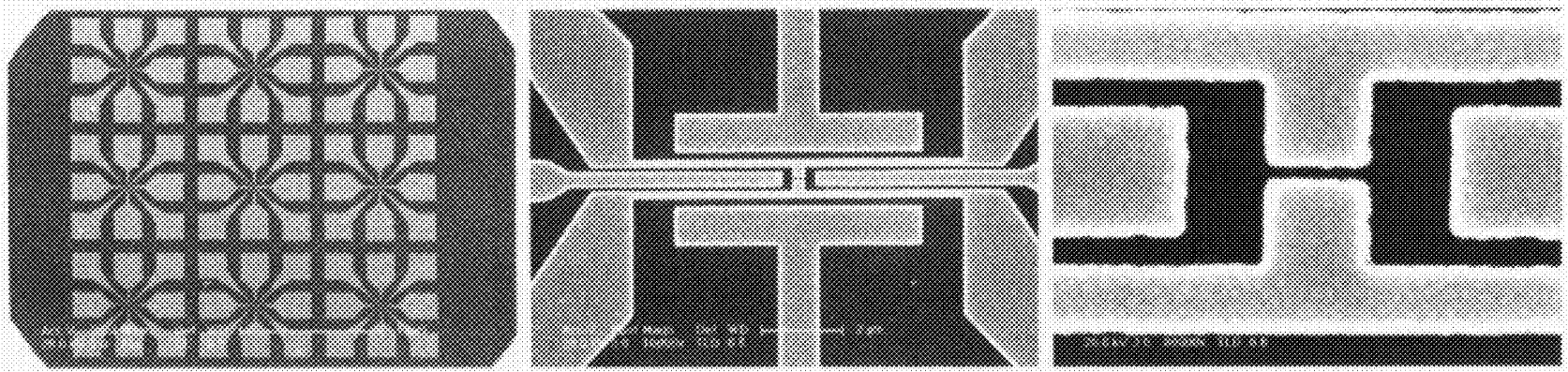
FIG. 11 is a diagram of a prototype NEMS switches with lateral protrusion contacts and complementary gate electrodes. The middle panel (FIG. 11B) shows a typical device. The left panel (FIG. 11A) shows a chip patterned with an array comprising a plurality of such devices. The right panel (FIG. 11C) shows an expanded view of the region of the lateral protrusion contact on the device, illustrating a 20 nm switching gap.

FIG. 11 illustrates a small array of the NEMS switches schematically shown in FIG. 5, and close-up views of a representative device in such an array. Typically electrostatic coupling gaps in the range of ~50-100 nm and switching gaps in the range of ~20-30 nm have been realized.

Device Operation

Very Low Voltage NEMS Switches

Figures 12A, 12B, 12C, 12D:
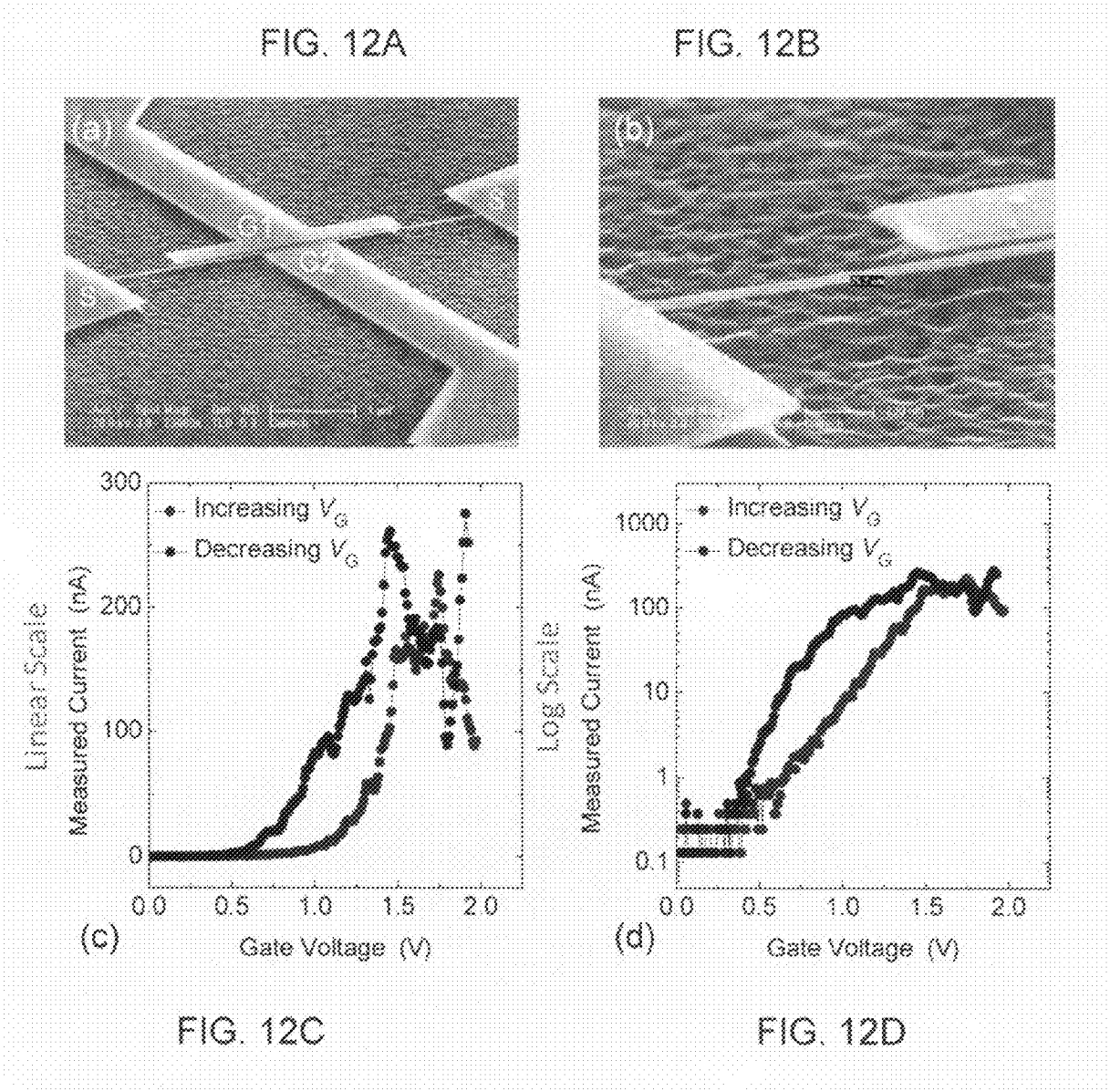
FIG. 12A shows a perspective view of a device with two gates, in which the large gate G1 and nanowire form a 2-terminal switch with very low actuation voltage, according to principals of the invention.
FIG. 12B is an expanded view of the suspended nanowire device of FIG. 12A, showing the thickness of the nanowire.
FIG. 12C is a diagram illustrating measured switching events showing ~1V on voltage, on a linear scale.
FIG. 12D is a diagram illustrating measured switching events showing ~1V on voltage, on a semi-log scale.

Attaining very small coupling gaps and very thin nanowire devices are important to realize very low actuation voltage. FIG. 12A shows an illustrative very low voltage NEMS switch with two lateral gate electrodes. The movable NEMS devices are actually very thin nanowires. The geometric variations in the two gates in FIG. 12A were provided to allow us to study the effects of the coupling gap and gate length on the actuation voltage. As shown in FIG. 12B, our processes typically yield devices with 50 nm×50 nm in cross section with coupling gaps in the range of 20-60 nm. In particular, for some devices, we have realized sub-30 nm wire widths and coupling gaps. When DC voltage is applied between a gate and the nanowire, the wire is pulled into the gate to make a contact and close or turn "on" a 2-terminal switch. When the DC voltage is reduced and/or removed, the device is restored to its original state, and the 2-terminal switch changes state to the "off" or non-conductive state. FIG. 12C shows the measured results current from the larger gate electrode to the device (G1 to S) as the actuation voltage applied to the same gate (G1) is increased. FIG. 12D shows the same data in a semi-log scale. It is clearly seen that the device demonstrates a turn on voltage of ~1.0V and a threshold voltage of ~0.5V. In FIG. 12C and FIG. 12D, hysteresis behavior is clearly seen. The particular NEMS device in this test is a bare silicon carbide (SiC) nanowire with dimensions of L×w×t=8 μm×50 nm×50 nm, and a gap of ~50 nm to the actuation gate. We have also realized ~25 nm gaps in some devices of this kind. Such small gaps would further reduce the actuation voltage for turning on the NEMS switch device. Switching on voltage of ~1V is exceptional as compared to the actuation voltages (often ~10-100V) required by modern micromachined devices.

We have designed such devices to attain switching times at the nano-second scale. Upon step excitation at the gate electrode, the ideal switching time would be close to ¼-cycle of the ringing period of the device, which is set by the resonance frequency of the device. The device shown in FIG. 12 has a resonance frequency at ~25 MHz and thus a switching time of less than 10 ns. Such a switching speed is about ~$10^2$-$10^3$ times faster than typical switching speeds achievable by state-of-the-art micromachined switches (>1-10 μs).

Figures 13, 13A, 13B:
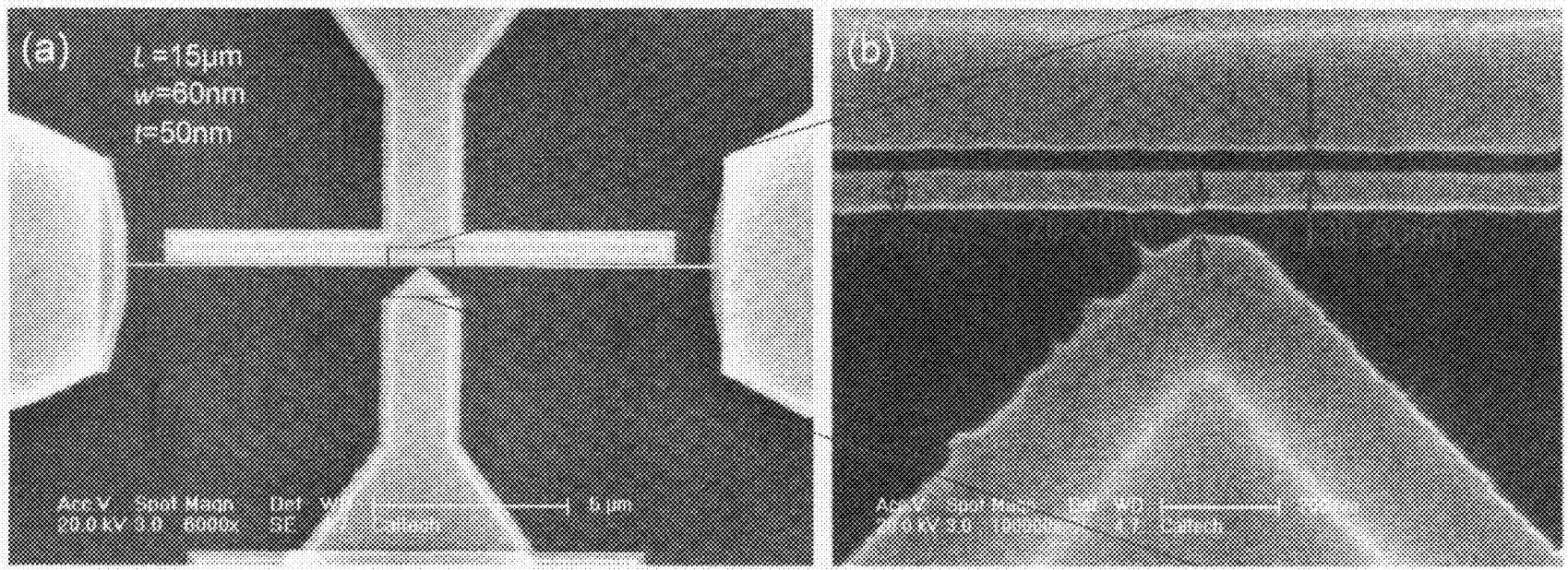
FIG. 13A is a plan view of a suspended NEMS switch device fabricated by the liftoff process.
FIG. 13B is an expanded view showing the nanowire width, the actuation coupling gap (typically 30 nm to 50 nm) and the point contact switching gap (typically 20 nm to 30 nm).
Figures 14, 14A, 14B:
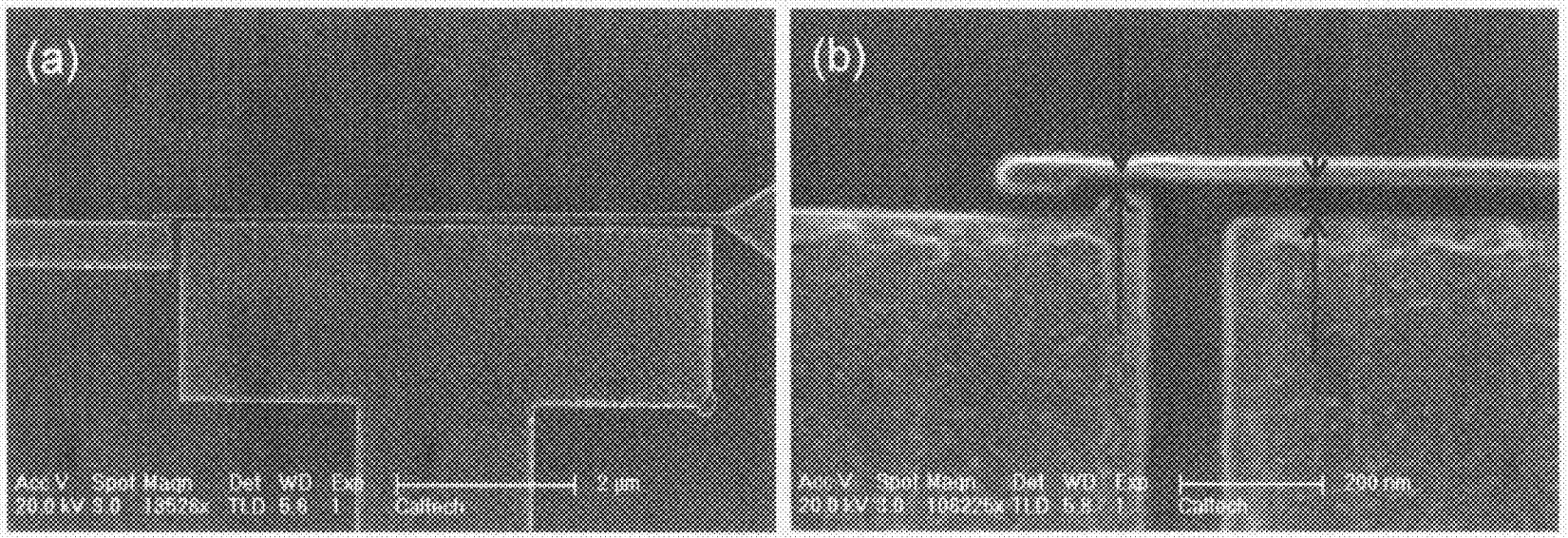
FIG. 14 is an illustration of a NEMS switch device made of 100 nm Si on oxide with very thin coupling and switching gaps. The right panel (FIG. 14B) shows an expanded view of part of the device shown in the left panel (FIG. 14A), illustrating a switching contact gap of 8 nm, and an actuation coupling gate of 30 nm.
Figure 15A:
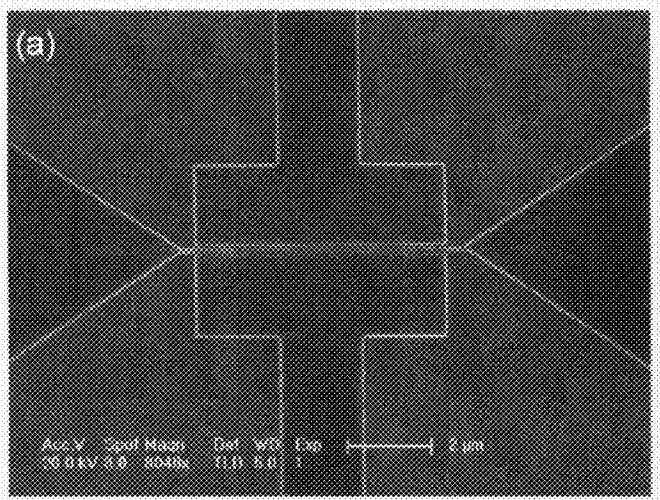
FIG. 15A illustrates a typical device.
Figure 15B:
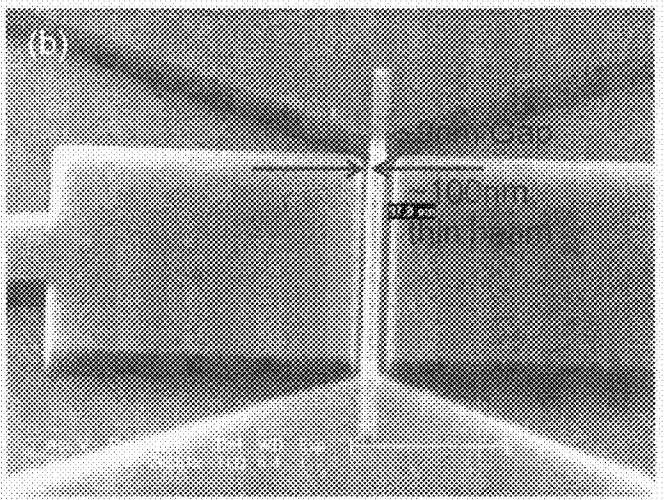
FIG. 15B demonstrates very thin gaps of 9 nm.
Figure 15C:
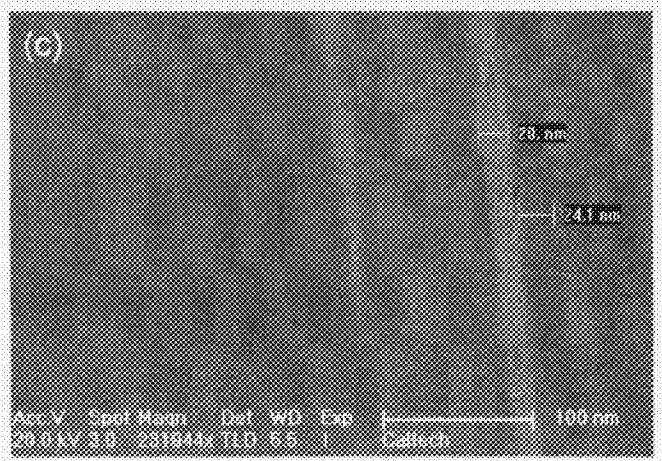
FIG. 15C and FIG. 15D illustrate thin top-down nanowires of 20 nm in width, along with 20 nm gaps to the gate. Both the nanowires and gaps are long, hence the very large aspect ratios.
Figure 15D:
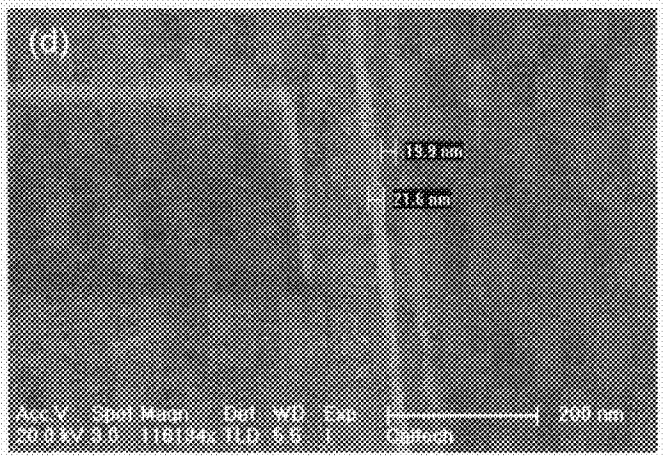

An important technical advance we have made is the demonstration of very thin nanogaps with very high aspect ratios (~200-500) in our top-down processes in making devices with various materials. FIG. 13 demonstrates typically achieved coupling gaps in the range of ~30-50 nm and point contact gaps in the range of ~20-30 nm in top-down nanowire switching devices made by the metallization-liftoff process. We have demonstrated such small nanogaps in materials including thin SiC layers on Si, thin Si on oxide, and $SiN_x$ on Si; and we expect that our process can be readily transferred to other heterogeneous films such as nanoscrystalline diamond on oxide, SiC on SOI (thin silicon on oxide), and other systems. FIG. 14 shows a device made of SOI using the metallization-liftoff process, with a switching gap of ~8 nm. We have developed the metallization-liftoff process by using Al, Au, Ti, and their composites as the deposited metal film.

Ultra-thin coupling gaps have also been realized in the HSQ negative mask process, as shown in FIG. 15, with gaps down to sub-10 nm. Moreover, the negative mask process has also enabled even thinner device width, allowing for making ~20 nm thin nanowires that are exceptionally promising for low voltage switching devices (see FIG. 15C and FIG. 15D). As shown by the dimensions measured in high-resolution scanning electron microscope, in FIG. 15B the beam has a width of 98.7 nm. In FIG. 15C the beam has a width of 20 nm, and the gap has a width of 24.1 nm. In FIG. 15D the beam has a width of 21.6 nm, and the gap has a width of 19.9 nm.

Two-Terminal NEMS Switches

A significant advantage of our processes is that we can realize complex structures in the device plane with precision control, e.g., multiple in-plane coupling gate electrodes with ultra-thin nanogaps. This in turn enables versatile designs of both 2- and 3-terminal switches. FIG. 16 shows a few typical data traces of low voltage switching events from 2-terminal NEMS DC switches made by the metallization-liftoff process. Note that in these devices the DC switching has been realized with metal-metal contacts.

Figure 16A:
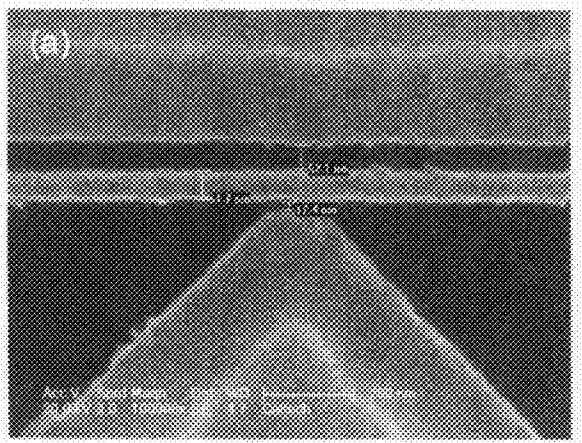
FIG. 16A and FIG. 16B illustrate the typical contact regions and the devices, respectively.
Figure 16B:
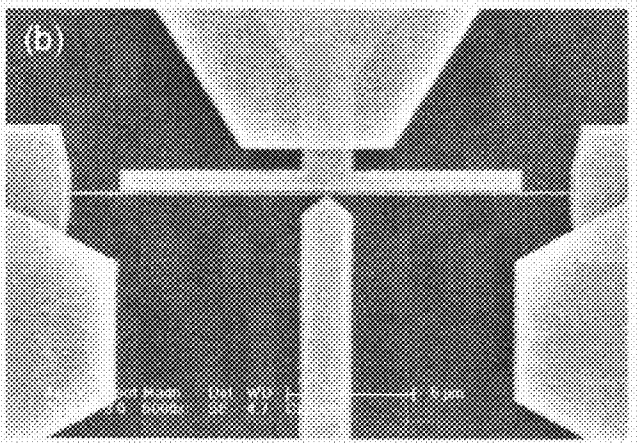
Figure 16C:
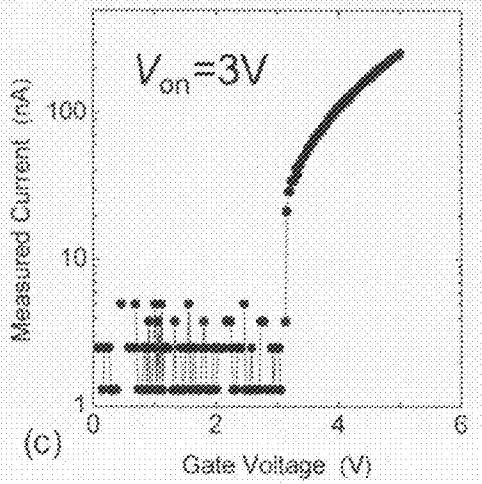
FIG. 16C, FIG. 16D and FIG. 16E show the measured raw data from several of such devices, illustrating the low-voltage switching behavior.
Figure 16D:
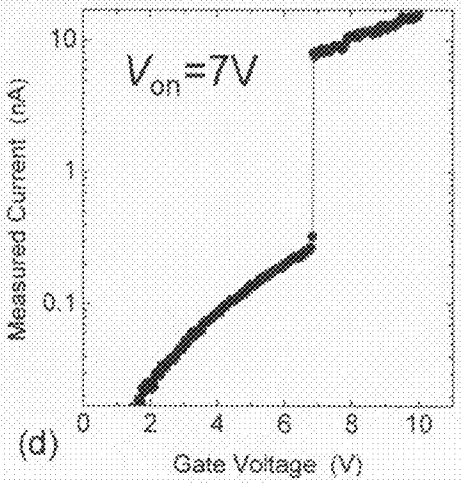
Figure 16E:
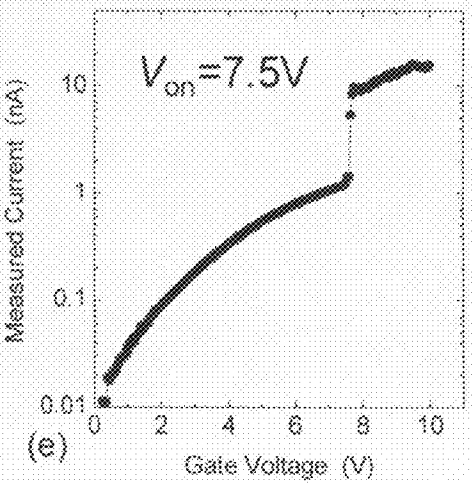

For the device shown in FIG. 16A, the width of the nanowire is 61.7 nm, the gap distance to the large gate electrode is 52.1 nm, and the gap distance to the point electrode is 17.4 nm.

Figures 17A, 17B:
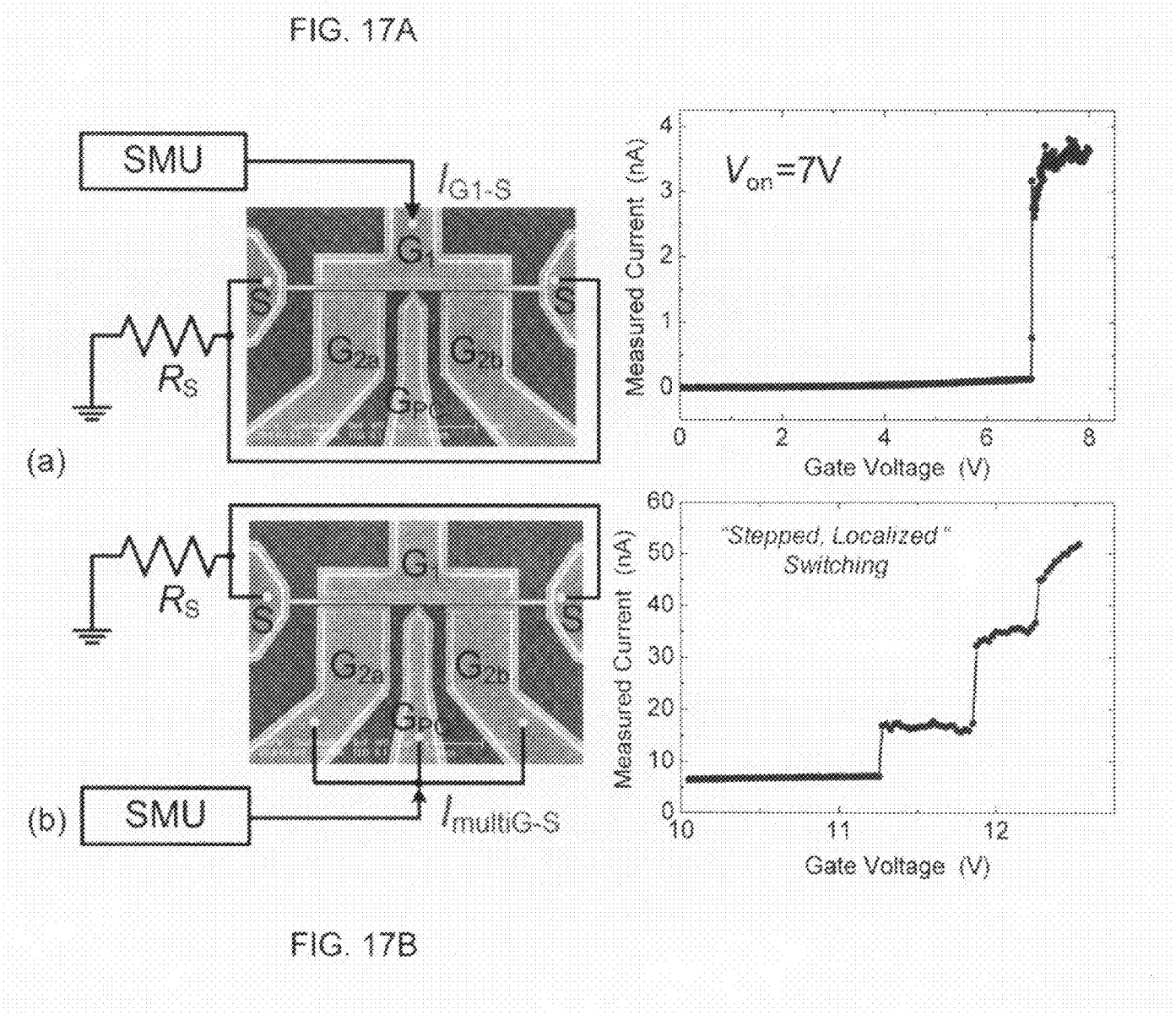
FIG. 17A is a diagram showing two-terminal NEMS switches based on top-down nanowires with point-contact and other complementary gates that switch at 7V via electrostatic pull-in to the big gate ($G_1$).
FIG. 17B is a diagram showing two-terminal switching by using the point-contact and two 3 μm-wide gates collectively.

NEMS devices with considerable in-plane complexity and multi-functionality have been realized, such as the devices with multiple gates shown in FIG. 17. Such complex structures can function as NEMS switches, resonators, and can also be used to study the nanoscale contact properties. We have first demonstrated low voltage switching events with metalized devices (Al on SiC on Si) and all-metal devices (Au) with such designs (e.g., FIG. 17A). In the same design, we have also demonstrated the multi-gate switching events (e.g., FIG. 17B). The measured data strongly suggests that due to local coupling strength of each gate, and the device's local rigidity, the pull-in behavior is differentiated at the three local gates. In FIG. 17A are shown two-terminal switching at 7V via electrostatic pull-in to the larger gate ($G_1$), using a device having dimensions 9 μm in length, 100 nm in width, and 50 nm in thickness. In FIG. 17B two-terminal switching is demonstrated using the point-contact and two 3 μm-wide gates collectively.

Figures 18, 18A, 18B, 18C:
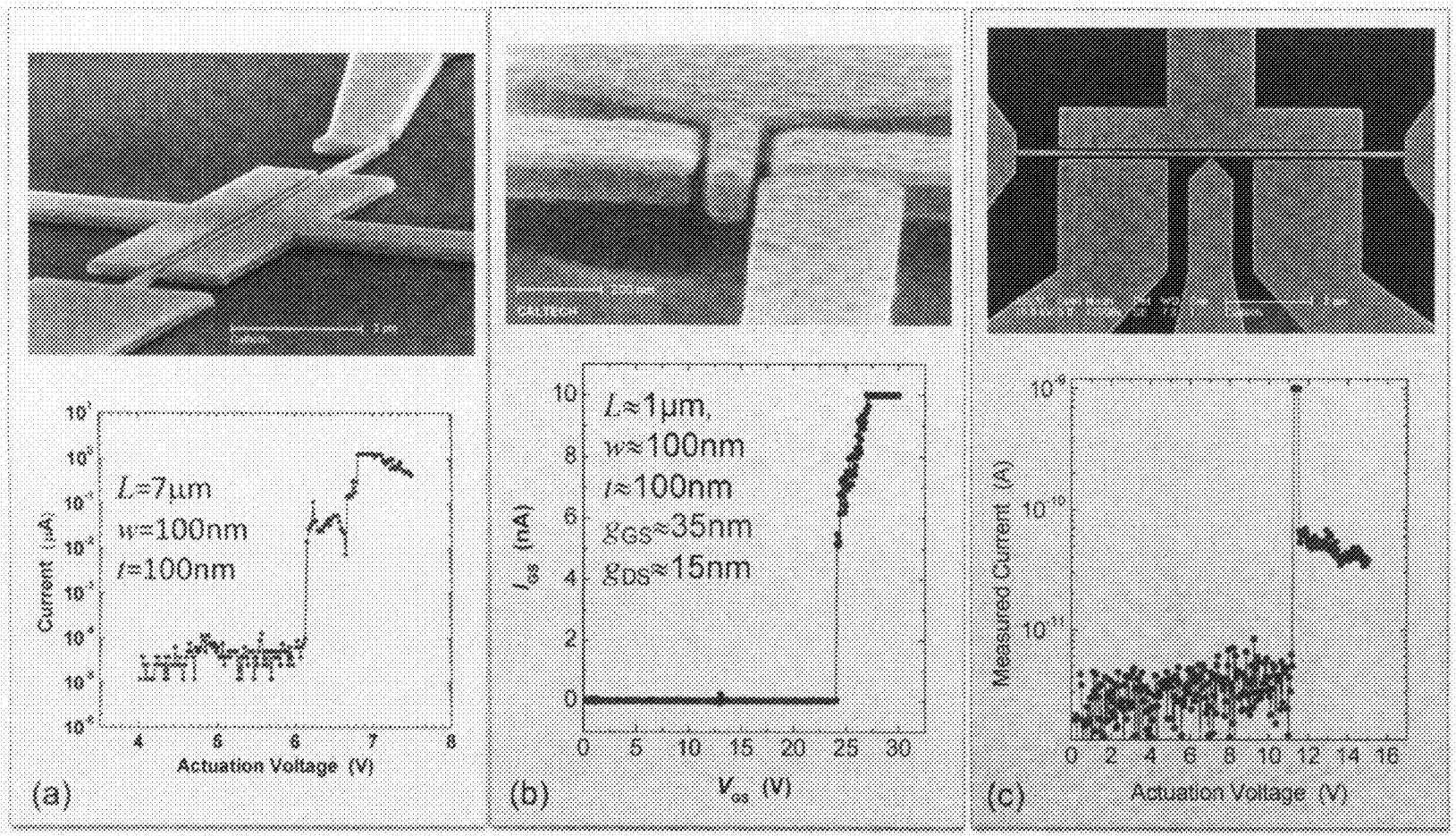
FIG. 18A, FIG. 18B and FIG. 18C are diagrams showing two-terminal NEMS switches based on (Au—) metalized single-crystal Si nanocantilevers and nanobeams made from SOI (silicon on oxide).

Moreover, we have also demonstrated two-terminal switching events in metalized SOI devices. As shown in FIG. 18A and FIG. 18C, doubly-clamped beams, and as shown in FIG. 18B, singly-clamped cantilevers, both with complementary gates, have been designed and fabricated as NEMS switches. By designing and wiring up the devices appropriately, we can use these devices either as two-terminal or three-terminal devices. In the examples shown in FIG. 18A, FIG. 1813, and FIG. 18C, the two-terminal switching events involve the devices being pulled to the larger coupling gates.

Three-Terminal NEMS Switches

Three-terminal switches require "gated" (i.e., gate-controlled) conductance for switching. This imposes more requirements in design and fabrication. The device has to be designed so that when the movable part of the NEMS is actuated, it makes or breaks contacts between source and drain, but is not pulled to the gate. The dimensions of the movable device, the actuation gap, the switching gap, the actuation voltage and the bias (drain-source) voltage, all need to be coordinated well in the practically quite limited design space.

FIG. 19 demonstrates illustrative switching data for a three-terminal device. Upon the increase of applied gate voltage, the measured drain-source current undergoes tunneling, rising, and saturation stages, while the concurrently measured gate-source current remains the minimum level (limited by the instruments and cables) as the voltage is increased (verifying that gate-source is insulated and there is no pull-in of the device to the actuation gate). The switching speed of such three-terminal devices can be modeled and predicted using finite element simulations.

FIG. 19A shows the measured drain-source current "gated" by the applied gate voltage and tuned by the bias voltage. For this device, the length is ~700 nm, the width is ~100 nm, the thickness is ~100 nm, the gate-source gap is ~75 nm, and the drain-source gap is ~15 nm. In FIG. 19B, there are shown simulations based on the finite element method (FEM) demonstrating that the expected switching speed of this particular device should be <2 ns.

Realizing such three-terminal NEMS switches is important for logic applications. Assembling and wiring up multiple and arrays of three-terminal NEMS switches would enable NEMS-based logic families and building blocks for logic circuits. Moreover, even in our initial demonstrations, the three-terminal devices have operated for many cycles, and the devices are much more robust, and the switching events are much less destructive, than in the case of two-terminal switches solely based on the electrostatic pull-in effect.

Resonant-Mode NEMS Switches

We have also demonstrated resonant-mode NEMS switches. Unlike the DC switches with which we normally observe a quasi-static behavior of the device as we ramp up the actuation voltage, here we excite the NEMS device into resonance. At resonance, as the vibration amplitude increases, the device starts impacting and making contact to a gate electrode, periodically. Such a resonant-contacting behavior can be directly exploited as a switching mechanism to periodically switch signals on and off. The resonant-switching is also a unique and nice platform for studying contact and tunneling physics in nanostructures. Another important advantage is that both frequency-domain and time-domain measurements of a resonant-mode switch lead to experimental determination of the device's switching speed.

Figure 20:
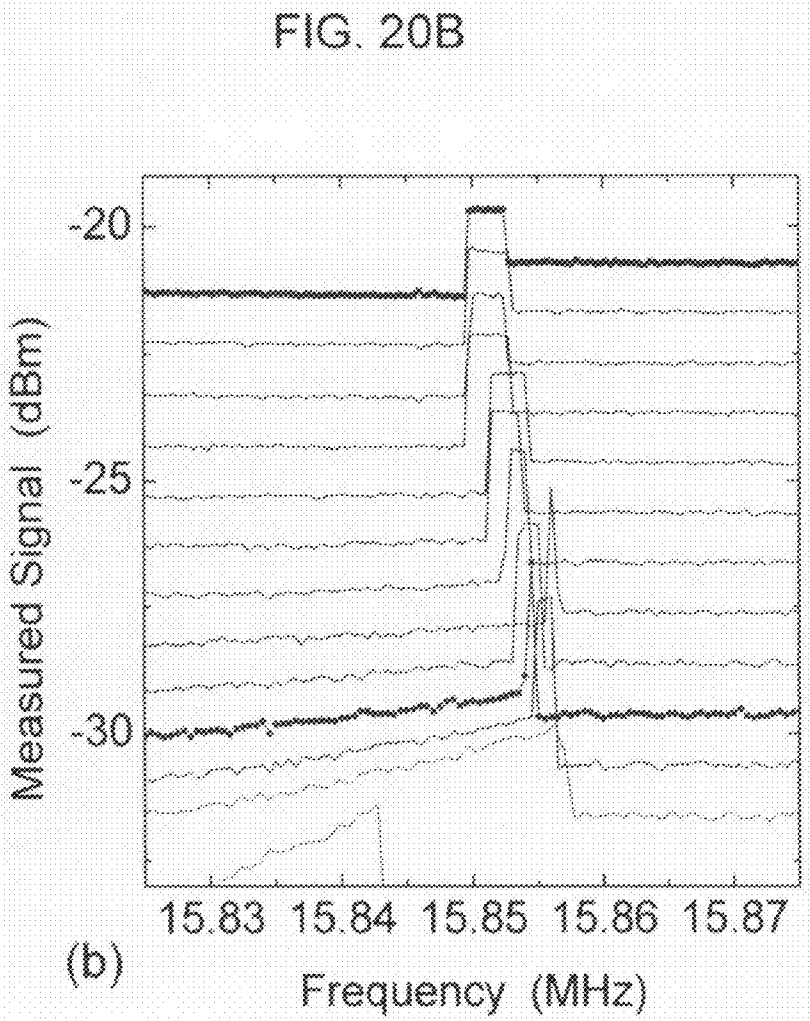
FIG. 20A is a diagram showing frequency-domain characteristics of a resonant-mode NEMS switch device.
FIG. 20B is a diagram showing an expanded view of the data traces of device's midpoint impacting gate electrode at very high amplitudes.
Figure 20:
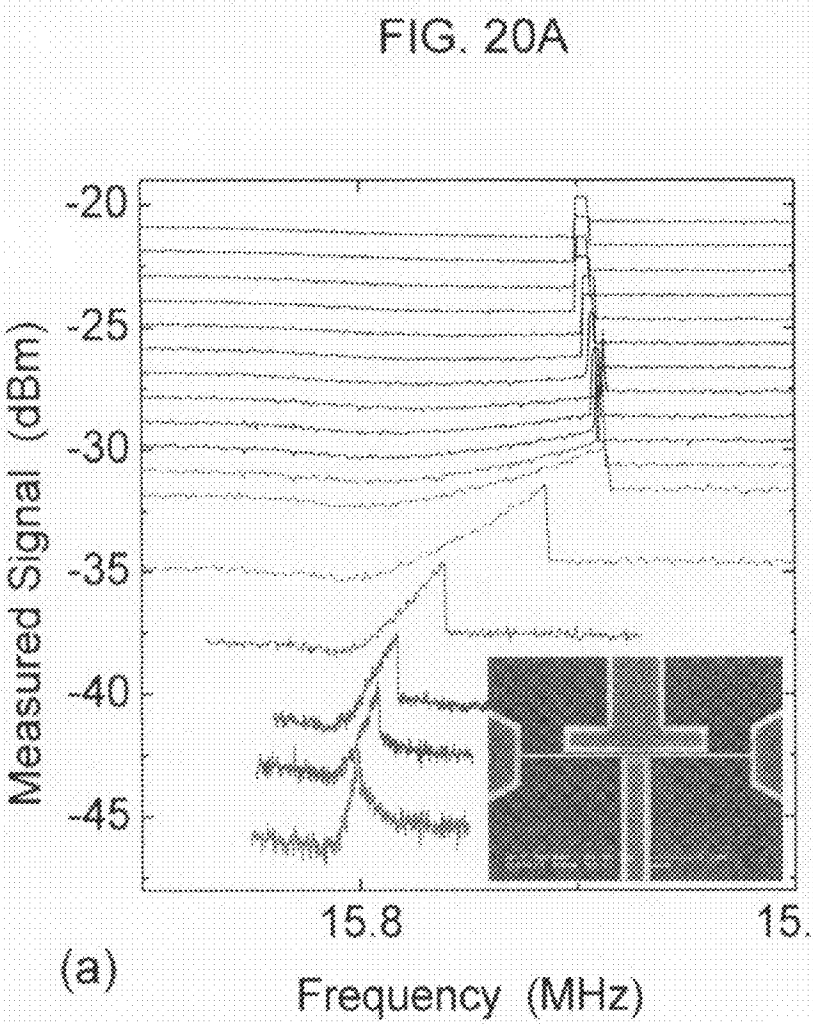

FIG. 20 shows the measured frequency-domain characteristics of a ~16 MHz resonant-mode switch. This device is a doubly-clamped beam with two coupling gates of different lengths. The device is made from a 50 nm thick SiC epitaxial layer with Al metallization. It has dimensions of L×w×t=8 μm×50 nm×50 nm, with gaps in the range of ~50-60 nm. This device offers a switching time of ~15 ns. In FIG. 20A, the frequency-domain data clearly show 3 phases of response as the amplitude of the nanowire or beam oscillation increases: (i) linear response, (ii) nonlinear Duffing response, and (iii) impacting the gate electrode. In FIG. 20B, the data traces for the beam oscillation appear to show the beam impacting the gate electrode at very high amplitudes.

FIG. 21 shows frequency-domain data from a much higher frequency, ~100 MHz resonant-mode switch. In this device, a point-contact gate is used and it has a 35 nm gap to the device. This device offers a switching time of just 2.5 ns. In FIG. 21A there is shown a device with a nanowire length of 2.5 μm, a width of 50 nm, a thickness of 50 nm, a gap to the larger gate (G1) of 50 nm, and a gap to the pointed gate of 35 nm. In FIG. 21B there are shown the measured responses showing nonlinear and impacting gate behaviors.

FIG. 22 shows both frequency- and time-domain characteristics measured from a device with multiple gates and a point-contact gate. The frequency-domain data again clearly demonstrate the three-stage response, linear, nonlinear, and impacting gate, as the resonant amplitude is increased. Note that in this device, there is a softening nonlinear pulling rather than a stiffening nonlinearity (as is the case for the devices shown in FIG. 20 and FIG. 21). Time-domain measurement of the ringing process of the device directly determines the vibrating period of the device, demonstrating a switching time of ~9 ns. FIG. 22A, FIG. 22B and FIG. 22C show images of the suspended device, local structures and nanogaps. FIG. 22D shows the measured frequency-domain responses showing linear, nonlinear and impacting gate behaviors. FIG. 22E shows the measured time-domain ringing behavior showing the speed of the device.

Devices such as shown in FIG. 23A, with further reduced dimensions, would function as ultra-high frequency (UHF) NEMS resonators and switches. Finite element simulations show that such a device can offer <1 ns switching time. The device illustrated in FIG. 23A has a length of 1 μm, a width and a thickness of 50 nm, a gap between the nanowire and the larger gate of 60 nm, and a gap between the nanowire and the pointed gate of 30 nm. FIG. 23B and FIG. 23C show finite element simulations of the device responses upon step excitation and resonant excitation, respectively. FIG. 23D shows a simulated response to a step excitation. FIG. 23E shows a simulated response to a resonant excitation.

Alternative Design

Ultrafast Extensional Mode Piezoelectric NEMS Switch with Lateral Contact

Lateral contacts can also be realized in devices with piezoelectric actuation. FIG. 24 shows designs of extensional mode piezoelectric NEMS switches with lateral contacts. For an electrode-piezoelectric material-electrode sandwiched structure, when voltage is applied to the top electrode and electrical field is built up across the piezoelectric material, the structure can extend in the longitudinal direction (with an appropriate arrangement of the stacking and the piezoelectric material's crystalline orientations). This effect can be engineered to make switches with lateral contacts and the switching speed scales as $t_s \sim L/c_{longitudinal}$, where L is length of a cantilever (with one end free) and $C_{longitudinal}$ is the wave speed along the longitudinal direction. As this longitudinal mode can be much higher speed than the flexural mode, this can lead to ultrafast NEMS switches.

Figures 24A, 24B, 24C, 24D:
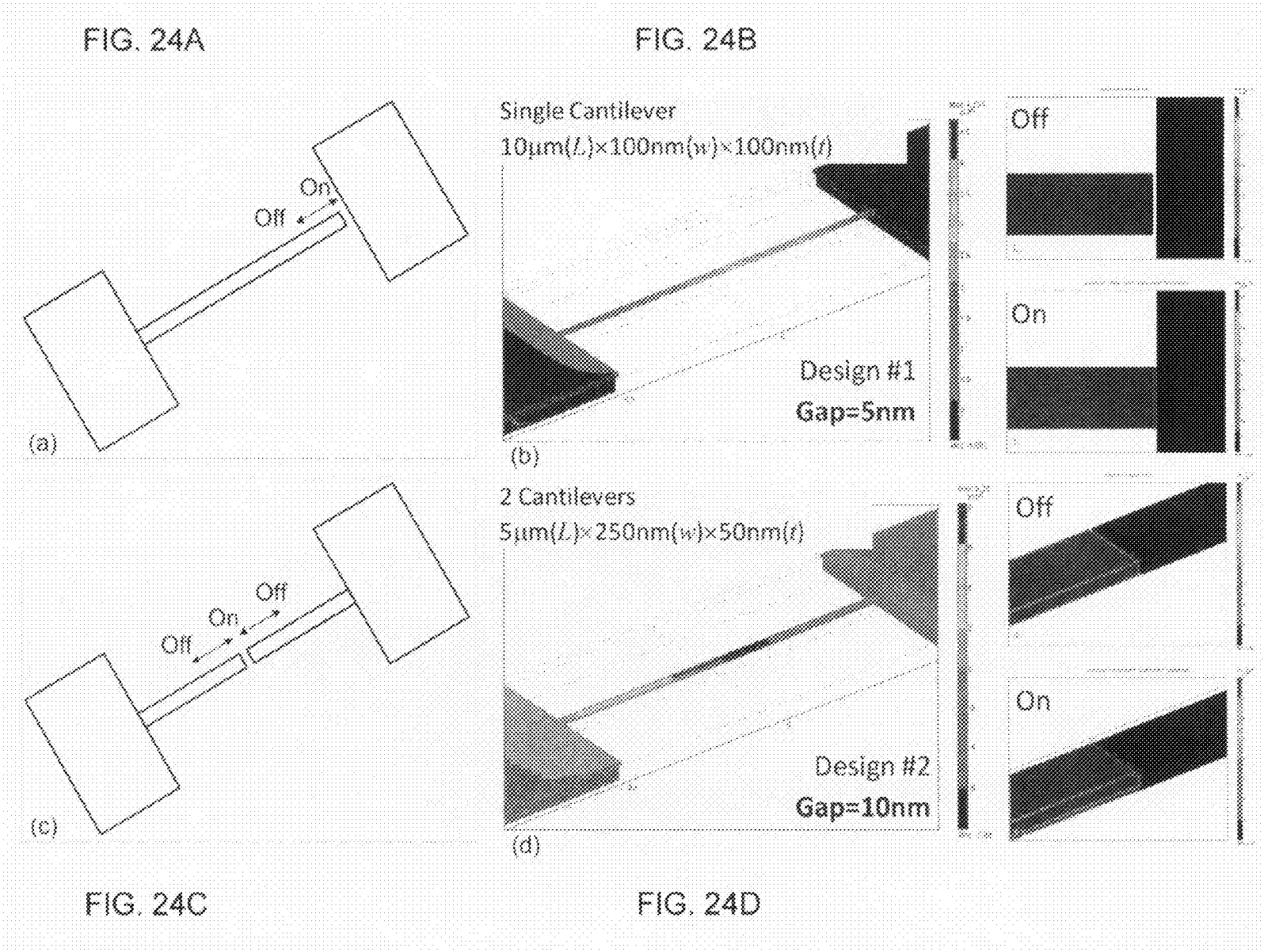
FIG. 24A is a schematic diagram of a single cantilever lateral extensional mode piezoelectric NEMS switch.
FIG. 24B is an illustration of the finite element simulation of a device illustrated in FIG. 24A. The device has dimensions of 10 μm (L)×100 nm (w)×100 nm (t) and a switching gap of 5 nm.
FIG. 24C is a schematic diagram of a double cantilever lateral extensional mode piezoelectric NEMS switch.
FIG. 24D illustrates the finite element simulation result for the device shown in FIG. 24C. In the particular device, each of the pair of cantilevers has dimensions of 5 μm (L)×250 nm (w)×50 nm (t) and a switching gap of 10 nm.

FIG. 24A is a schematic diagram of a single cantilever switch device. FIG. 24B shows the finite element simulation results for a single cantilever with dimensions 10 μm (L)×100 nm (w)×100 nm (t). For a lateral gap of 5 nm, the device switches on/off with a switching time of 1 ns. FIG. 24C is a schematic diagram of a complementary switch device design based on a double cantilever structure, each cantilever having dimensions 5 μm (L)×250 nm (w)×50 nm (t). FIG. 24D shows the finite element simulation results. For a lateral gap of 10 nm, this device switches on/off with a switching time of 0.5 ns. Such simulations are based on AlN piezoelectric material. Similar device designs are possible based on ZnO, GaAs, and GaN materials.

It is expected that any of the nanoelectromechanical switches described herein will be compatible with circuitry that is operable in computer-based systems, and will be capable of being fabricated in conventional semiconductor processing environments, leading to ease of integration of such switches with conventional circuitry used to receive signals, provide signals, process signals, display signals, and store signals.

Definitions

Recording the results from an imaging operation or image acquisition, such as for example, recording results at a particular wavelength, is understood to mean and is defined herein as writing output data to a storage element, to a machine-readable storage medium, or to a storage device. Machine-readable storage media that can be used in the invention include electronic, magnetic and/or optical storage media, such as magnetic floppy disks and hard disks; a DVD drive, a CD drive that in some embodiments can employ DVD disks, any of CD-ROM disks (i.e., read-only optical storage disks), CD-R disks (i.e., write-once, read-many optical storage disks), and CD-RW disks (i.e., rewriteable optical storage disks); and electronic storage media, such as RAM, ROM, EPROM, Compact Flash cards, PCMCIA cards, or alternatively SD or SDIO memory; and the electronic components (e.g., floppy disk drive, DVD drive, CD/CD-R/CD-RW drive, or Compact Flash/PCMCIA/SD adapter) that accommodate and read from and/or write to the storage media. As is known to those of skill in the machine-readable storage media arts, new media and formats for data storage are continually being devised, and any convenient, commercially available storage medium and corresponding read/write device that may become available in the future is likely to be appropriate for use, especially if it provides any of a greater storage capacity, a higher access speed, a smaller size, and a lower cost per bit of stored information. Well known older machine-readable media are also available for use under certain conditions, such as punched paper tape or cards, magnetic recording on tape or wire, optical or magnetic reading of printed characters (e.g., OCR and magnetically encoded symbols) and machine-readable symbols such as one and two dimensional bar codes. Recording image data for later use (e.g., writing an image to memory or to digital memory) can be performed to enable the use of the recorded information as output, as data for display to a user, or as data to be made available for later use. Such digital memory elements or chips can be standalone memory devices, or can be incorporated within a device of interest. "Writing output data" or "writing an image to memory" is defined herein as including writing transformed data to registers within a microcomputer.

"Microcomputer" is defined herein as synonymous with microprocessor, microcontroller, and digital signal processor ("DSP"). It is understood that memory used by the microcomputer, including for example an imaging or image processing algorithm coded as "firmware" can reside in memory physically inside of a microcomputer chip or in memory external to the microcomputer or in a combination of internal and external memory. Similarly, analog signals can be digitized by a standalone analog to digital converter ("ADC") or one or more ADCs or multiplexed ADC channels can reside within a microcomputer package. It is also understood that field programmable array ("FPGA") chips or application specific integrated circuits ("ASIC") chips can perform microcomputer functions, either in hardware logic, software emulation of a microcomputer, or by a combination of the two. Apparatus having any of the inventive features described herein can operate entirely on one microcomputer or can include more than one microcomputer.

General purpose programmable computers useful for controlling instrumentation, recording signals and analyzing signals or data according to the present description can be any of a personal computer (PC), a microprocessor based computer, a portable computer, or other type of processing device. The general purpose programmable computer typically comprises a central processing unit, a storage or memory unit that can record and read information and programs using machine-readable storage media, a communication terminal such as a wired communication device or a wireless communication device, an output device such as a display terminal, and an input device such as a keyboard. The display terminal can be a touch screen display, in which case it can function as both a display device and an input device. Different and/or additional input devices can be present such as a pointing device, such as a mouse or a joystick, and different or additional output devices can be present such as an enunciator, for example a speaker, a second display, or a printer. The computer can run any one of a variety of operating systems, such as for example, any one of several versions of Windows, or of MacOS, or of UNIX, or of Linux. Computational results obtained in the operation of the general purpose computer can be stored for later use, and/or can be displayed to a user. At the very least, each microprocessor-based general purpose computer has registers that store the results of each computational step within the microprocessor, which results are then commonly stored in cache memory for later use.

Many functions of electrical and electronic apparatus can be implemented in hardware (for example, hard-wired logic), in software (for example, logic encoded in a program operating on a general purpose processor), and in firmware (for example, logic encoded in a non-volatile memory that is invoked for operation on a processor as required). The present invention contemplates the substitution of one implementation of hardware, firmware and software for another implementation of the equivalent functionality using a different one of hardware, firmware and software. To the extent that an implementation can be represented mathematically by a transfer function, that is, a specified response is generated at an output terminal for a specific excitation applied to an input terminal of a "black box" exhibiting the transfer function, any implementation of the transfer function, including any combination of hardware, firmware and software implementations of portions or segments of the transfer function, is contemplated herein.

Theoretical Discussion

Although the theoretical description given herein is thought to be correct, the operation of the devices described and claimed herein does not depend upon the accuracy or validity of the theoretical description. That is, later theoretical developments that may explain the observed results on a basis different from the theory presented herein will not detract from the inventions described herein.

Any patent, patent application, or publication identified in the specification is hereby incorporated by reference herein in its entirety. Any material, or portion thereof, that is said to be incorporated by reference herein, but which conflicts with existing definitions, statements, or other disclosure material explicitly set forth herein is only incorporated to the extent that no conflict arises between that incorporated material and the present disclosure material. In the event of a conflict, the conflict is to be resolved in favor of the present disclosure as the preferred disclosure.

While the present invention has been particularly shown and described with reference to the preferred mode as illustrated in the drawing, it will be understood by one skilled in the art that various changes in detail may be affected therein without departing from the spirit and scope of the invention as defined by the claims.

What is claimed is:

1. A nanoelectromechanical switch, comprising:

a substrate having a surface;

a layer of conductive material in supported relation to said surface of said substrate, said layer of conductive material having defined therein a nanoelectromechanical switching structure, said nanoelectromechanical switching structure comprising:

at least one contact electrode having a contact region and having an electrical signal terminal;

at least one nanowire having at least one point of support in said layer of conductive material and having an electrical signal terminal, said nanowire configured to move along a plane situated within said layer of conductive material and relative to said at least one electrical contact in response to an electrical signal applied to a gate electrode to control an electrical conduction state between said at least one contact electrode and said nanowire to be a selected one of conduction and lack of conduction, said gate electrode disposed in proximity to said nanowire; and at least one pair of electrical terminals configured to provide connection of said switching structure to an external circuit;

said nanoelectromechanical switching structure configured to respond to said signal applied to said gate electrode in a response time of less than 10 nanoseconds.

2. The nanoelectromechanical switch of claim 1, further comprising an insulating layer between said substrate and said layer of conductive material.

3. The nanoelectromechanical switch of claim 1, wherein said response time is less than 1 nanosecond.

4. The nanoelectromechnical switch of claim 1, wherein said signal applied to said gate electrode is a voltage signal of substantially one volt.

5. The nanoelectromechnical switch of claim 1, wherein said signal applied to said gate electrode is a voltage signal of less than one volt.

6. The nanoelectromechnical switch of claim 1, wherein said conductive material comprises a selected one of silicon, diamond, and silicon carbide.

7. The nanoelectromechnical switch of claim 1, wherein at least one of said at least one contact and said nanowire is metallized with a metal selected from the group consisting of gold, platinum, silver, titanium, copper, and aluminum.

8. The nanoelectromechnical switch of claim 1, wherein said nanowire is supported by said layer of conductive material at two points.

9. The nanoelectromechnical switch of claim 1, wherein said switch is configured as a two terminal device.

10. The nanoelectromechnical switch of claim 1, wherein said electrical signal applied to said gate electrode to control an electrical conduction state is a DC electrical signal.

11. The nanoelectromechnical switch of claim 1, further comprising at least a second contact electrode, said second contact electrode having a contact region and having an electrical terminal configured to receive an electrical signal.

12. The nanoelectromechnical switch of claim 11, wherein said nanowire and said contact electrodes are configured as a three terminal device.

13. The nanoelectromechnical switch of claim 1, wherein said electrical signal applied to said gate electrode to control an electrical conduction state is an AC electrical signal.

14. The nanoelectromechnical switch of claim 1, wherein said gate electrode has a pointed configuration.

15. The nanoelectromechnical switch of claim 1, further comprising a second gate electrode, said second gate electrode configured to pull said nanowire away from said contact region of said contact electrode.

16. The nanoelectromechnical switch of claim 1, comprising two doubly-clamped nanowires, each having a protruding region, said two protruding regions configured to provide contact with each other.

17. The nanoelectromechnical switch of claim 1, wherein said nanoelectromechanical switch is configured to operate in a resonant mode in response to an applied control signal.

* * * * *